US011222778B2

(12) United States Patent
Kovtoun et al.

(10) Patent No.: US 11,222,778 B2
(45) Date of Patent: Jan. 11, 2022

(54) MULTI-ELECTROSPRAY ION SOURCE FOR A MASS SPECTROMETER

(71) Applicant: Thermo Finnigan LLC, San Jose, CA (US)

(72) Inventors: Viatcheslav V. Kovtoun, San Jose, CA (US); Eloy R. Wouters, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 104 days.

(21) Appl. No.: 16/668,414

(22) Filed: Oct. 30, 2019

(65) Prior Publication Data

US 2021/0134580 A1 May 6, 2021

(51) Int. Cl.
*H01J 49/16* (2006.01)

(52) U.S. Cl.
CPC ..... *H01J 49/167* (2013.01)

(58) Field of Classification Search
CPC ..... H01J 49/0404; H01J 49/167; H01J 49/04; H01J 49/107; H01J 49/165
See application file for complete search history.

(56) References Cited

U.S. PATENT DOCUMENTS 6,501,073 B1 * 12/2002 Mylchreest ..... H01J 49/04 250/288
6,649,908 B2 11/2003 Apffel, Jr.
7,470,899 B2 12/2008 Atherton et al.
8,207,496 B2 6/2012 Makarov et al.
8,237,115 B2 8/2012 Kovtoun et al.
8,309,916 B2 11/2012 Wouters et al.
8,410,431 B2 4/2013 Ouyang et al.
8,642,946 B2 2/2014 Splendore et al.
8,847,154 B2 9/2014 Wouters et al.
9,105,455 B2 8/2015 Brown et al.
10,103,014 B2 10/2018 Newton
10,297,435 B2 5/2019 Oleschuk et al.
10,388,501 B1 8/2019 Liu et al.
(Continued)

FOREIGN PATENT DOCUMENTS

EP 1021819 A1 7/2000
EP 1703541 A2 9/2006
WO 9913492 A1 3/1999

OTHER PUBLICATIONS

Regele et al., "Effects of capillary spacing on EHD spraying from anarray of cone jets", Aerosol Science 33 (2002), pp. 1471-1479.
(Continued)

*Primary Examiner* — Brooke Purinton
(74) *Attorney, Agent, or Firm* — Thomas F. Cooney

(57) ABSTRACT

An electrospray ion source for a mass spectrometer comprises: (i) a plurality of N electrospray emitters within an ionization compartment, wherein N≥2; (ii) a mixing chamber; (iii) a plurality of N inlets, each inlet comprising a conduit configured to receive charged particles from a respective one of the electrospray emitters and to emit the charged particles into the mixing chamber; (iv) an outlet port either facing or within an intermediate-vacuum compartment; and (v) a heater in thermal contact with at least a portion of the mixing chamber.

24 Claims, 13 Drawing Sheets

(56) References Cited

U.S. PATENT DOCUMENTS

| | | | | |
|---|---|---|---|---|
| 2003/0052269 | A1* | 3/2003 | Apffel, Jr. ..... | H01J 49/107 250/288 |
| 2003/0106996 | A1* | 6/2003 | Covey ..... | H01J 49/165 250/288 |
| 2003/0168591 | A1 | 9/2003 | Smith et al. | |
| 2004/0227072 | A1* | 11/2004 | Park ..... | H01J 49/107 250/288 |
| 2011/0049348 | A1 | 3/2011 | Wells | |
| 2011/0147576 | A1 | 6/2011 | Wouters et al. | |
| 2011/0260048 | A1 | 10/2011 | Wouters et al. | |
| 2012/0153141 | A1 | 6/2012 | Wouters et al. | |
| 2013/0327936 | A1 | 12/2013 | Ramsey et al. | |
| 2016/0329198 | A1 | 11/2016 | Badu-Tawiah et al. | |

OTHER PUBLICATIONS

Rulison et al., "Scale-up of electrospray atomization usinglinear arrays of Taylor cones", Review of Scientific Instruments 64, (1993), pp. 683-686; https://doi.org/10.1063/1.1144197.

Si et al., "Experimental and theoretical study of a cone-jet. for an electrospray microthruster considering the interference effect in anarray of nozzles", Aerosol Science 38 (2007), pp. 924-934.

Thompson et al., "Investigation of Electrospray Ionizationand Electrostatic Focusing Devices Using a Three-Dimensional Electrospray Current Density Profiler", J Am Soc Mass Spectrom 2005, 16, pp. 312-323.

Cox et al., "Improving the Sensitivity of Mass Spectrometry by Using a New Sheath Flow Electrospray Emitter Array at Subambient Pressures", J. Am. Soc. Mass Spectrom., 2014 (25), pp. 2028-2037.

Kelly et al., "Array of Chemically Etched Fused-Silica Emittersfor Improving the Sensitivity and Quantitation of Electrospray Ionization Mass Spectrometry", Anal. Chem. 2007, 79, pp. 4192-4198.

Tang et al., "Generation of Multiple Electrosprays Using Microfabricated Emitter Arrays for Improved MassSpectrometric Sensitivity", Anal. Chem. 2001, 73, pp. 1658-1663.

* cited by examiner

MULTI-ELECTROSPRAY ION SOURCE FOR A MASS SPECTROMETER

FIELD OF THE INVENTION

The present invention relates to ionization sources for mass spectrometry and, in particular, to multiple electrospray ion sources interfaced to a single mass spectrometer.

BACKGROUND OF THE INVENTION

The well-known technique of electrospray ionization is used in mass spectrometry to produce ions. In conventional electrospray ionization, a liquid is pushed through a very small charged capillary. This liquid contains the analyte to be studied dissolved in a large amount of solvent, which is usually more volatile than the analyte. The conventional electrospray process involves breaking the meniscus of a charged liquid formed at the end of the capillary tube into fine droplets using an electric field. The electric field induced between the electrode and the conducting liquid initially causes a Taylor cone to form at the tip of the tube where the field becomes concentrated. Fluctuations cause the cone tip to break up into fine droplets which are sprayed, under the influence of the electric field, into an ionization compartment at atmospheric pressure, optionally in the presence of drying gases. The optionally heated drying gas causes the solvent in the droplets to evaporate. According to a generally accepted theory, as the droplets shrink, the charge concentration in the droplets increases. Eventually, the repulsive force between ions with like charges exceeds the cohesive forces and the ions are ejected (desorbed) into the gas phase. The ions are attracted to and pass through a capillary or sampling orifice into the mass analyzer.

Incomplete droplet evaporation and ion desolvation can cause high levels of background counts in mass spectra, thus causing interference in the detection and quantification of analytes present in low concentration. It has been observed that smaller initial electrospray droplets tend to be more readily evaporated and, further, that droplet sizes decrease with decreasing flow rate. Thus, it is desirable to reduce the flow rate and, consequently, the droplet size. For example, nano-electrospray, with flow rates per emitter in the range of less than several hundred nanoliters per minute to 1 nanoliter per minute, has been found to yield very good results, in this regard. For example, FIG. 1 illustrates an array of fused-silica capillary nano-electrospray ionization emitters arranged in a circular geometry, as taught in United States Patent Application Publication 2009/0230296 A1, in the names of Kelly et al. Each nano-electrospray ionization emitter 2 comprises a fused silica capillary having a tapered tip 3. As taught in United States Patent Application Publication 2009/0230296 A1, the tapered tips can be formed either by traditional pulling techniques or by chemical etching and the radial arrays can be fabricated by passing approximately 6 cm lengths of fused silica capillaries through holes in one or more discs 1. The holes in the disc or discs may be placed at the desired radial distance and inter-emitter spacing and two such discs can be separated to cause the capillaries to run parallel to one another at the tips of the nano-electrospray ionization emitters and the portions leading thereto.

FIG. 2 is a simplified schematic diagram of a general conventional mass spectrometer system 10 comprising an electrospray ion source 87, which may comprise either a single electrospray emitter or an array of emitters. The electrospray source 87 is configured to receive a liquid sample from an associated apparatus such as for instance a liquid chromatograph or syringe pump through a capillary tube 7. The electrospray source 87 emits a "spray" of charged particles 84 (either ions or charged droplets that may be desolvated so as to release ions) that are representative of the sample into an ionization compartment 82. The droplets or ions are entrained in a background gas that may be provided from a separate sheath-gas tube or nebulization-gas tube (not shown) included within the electrospray ion source 87. A portion of the charged particles and background gas are intercepted by an ion transfer tube 92 that transports the particles from the ionization compartment 82 to an intermediate-vacuum compartment 83 that is maintained at a lower pressure (generally less than 10 Torr) than the pressure (generally atmospheric) of the ionization compartment 82. The ion transfer tube 92 may be thermally coupled to a heater 23 that provides heat to the gas and entrained particles in the ion transfer tube so as to aid in desolvation of charged droplets so as to thereby release free ions. One or more power supplies 31 provide appropriate radio-frequency (RF) and DC voltages to various electrodes of the mass spectrometer, including an electrode portion of the electrospray emitter 87.

As a result of the pressure difference between the ionization compartment 82 and the intermediate-vacuum compartment 83 (FIG. 2), gases and entrained ions and charged droplets are caused to flow through ion transfer tube 92 into the intermediate-vacuum compartment 83. A second partition element or wall 15 separates the intermediate-vacuum compartment 83 from either a high-vacuum compartment 26 or possibly a second intermediate-vacuum compartment (not shown), which is maintained at a pressure that is lower than that of compartment 83 but higher than that of high-vacuum compartment 26. Ion optical assembly or ion lens 20 provides an electric field or electric fields (derived from RF and/or DC voltages provided by power supply 31) that guide and focus the ion stream leaving ion transfer tube 16 through an aperture 22 in the second partition element or wall 15 that may be an aperture of a skimmer 21. A second ion optical assembly or lens 24 may be provided so as to transfer or guide ions to the mass analyzer 28. The ion optical assemblies or lenses 20, 24 may comprise transfer elements, such as, for instance a multipole ion guide, so as to direct the ions through the aperture 22 and into the mass analyzer 28. The mass analyzer 28 comprises one or more detectors 30 whose output can be displayed as a mass spectrum. Vacuum port 13 is used for evacuation of the intermediate-vacuum compartment 83 and vacuum port 19 is used for evacuation of the high-vacuum compartment 26. Additional intermediate vacuum compartments and/or ion manipulation components, such as mass filters, ion storage devices, ion fragmentation cells, etc. may be disposed along the general ion pathway within the mass spectrometer system 10.

It is generally found that, when arrays of electrospray emitters are employed, the observed electrospray current increases in proportion to the square root of the number, n, of electrospray emitters (e.g., U.S. Pat. No. 10,297,435 in the names of inventors Oleschuk et al.). This limitation on the electrospray current and, consequently, on the magnitude of the observable mass spectrometer ion signal, is attributed to interference between each Taylor cone and the electrostatic fields associated with Taylor cones of adjacent electrospray emitters. The individual Taylor cones tend to be deflected away from one another, thus causing the trajectories of emitted spray jets to deviate from their intended targets, which are typically inlets of a mass spectrometer. Experimental work has indicated that, in order to significantly reduce such interference, electrospray emission tips should be spaced at least 3 mm from one another. Preferably, the emission tips should be spaced at least 5 mm from one another in order to substantially reduce the interference. However, such wide electrospray spacing creates other difficulties relating to centering resulting ion streams within a mass spectrometer, where typical ion pathways are at most several hundred microns wide. Accordingly, there is a need in the art of mass spectrometry for apparatuses, systems and methods for inletting electrospray-generated ions with greater efficiency.

SUMMARY

In accordance with a first aspect of the present teachings, an electrospray ion source for a mass spectrometer is provided, the electrospray ion source comprising: (i) a plurality of N electrospray emitters within an ionization compartment, wherein N≥2; (ii) a mixing chamber; (iii) a plurality of N inlets, each inlet comprising a conduit configured to receive charged particles from a respective one of the electrospray emitters and to emit the charged particles into the mixing chamber; (iv) an outlet port either facing or within an intermediate-vacuum compartment; and (v) a heater in thermal contact with at least a portion of the mixing chamber. In various embodiments, the electrospray ion source may further comprise: a plurality of electrodes disposed within the mixing chamber between the plurality of inlets and the outlet port; and a power supply configured to supply a respective DC voltage to each one of the plurality of electrodes, whereby the supplied voltages either progressively increase or progressively decrease from a first end to an opposite end of the mixing chamber, wherein the power supply is not configured to supply an RF voltage to any of the plurality of electrodes. According to various embodiments, the mixing chamber comprises a central longitudinal axis thereof and each and every inlet conduit is disposed at the same non-zero angle, $\alpha$, with respect to the central longitudinal axis extended. According to some such embodiments, the central longitudinal axis is also a central longitudinal axis of an outlet tube or an outlet tube section that has the outlet port. According to some embodiments, some inlet conduits are disposed at a first angle, $\alpha_1$, and some inlet conduits are disposed at a second angle, $\alpha_2$, with respect to the central longitudinal axis extended, where the angles $\alpha_1$ and $\alpha_2$ are not both equal to zero.

According to various embodiments, each electrospray emitter comprises an emission tip and all N emission tips lie on a common circle. According to various embodiments, each emission tip is disposed at a distance of at least 3 mm from every other emission tip. According to some such embodiments, each emission tip is disposed at a distance of at least 5 mm from every other emission tip. According to various embodiments, each emission tip comprises a conical portion having a cone axis, wherein each cone axis is aligned with a longitudinal axis of the inlet that is configured to receive the charged particles emitted from said each emission tip. According to some embodiments, the mixing chamber, the plurality of N inlets and the outlet port are all portions of a single integral ion transfer tube.

In accordance with a second aspect of the present teachings, a mass spectrometry method comprises: (a) providing an ionization compartment; (b) providing a mixing chamber; (c) providing an outlet port configured to transfer charged particles from the mixing chamber to an evacuated compartment of a mass spectrometer; (d) providing a plurality of N electrospray emitters within the ionization compartment, wherein each electrospray emitter comprises an emission tip comprising a conduit that is disposed at a non-zero angle, $\alpha$, to an extension of a central longitudinal axis of the mixing chamber and wherein no two emission tips are within 3 mm of one other; and (e) providing a plurality of inlets, each inlet comprising a conduit configured to receive a portion of the charged particles from a respective one of the electrospray emitters and to transfer the portion of the charged particles into the mixing chamber. According to some embodiments, the central longitudinal axis of the mixing chamber is also a central longitudinal axis of an outlet tube that has the outlet port. According to some embodiments, the angle, $\alpha$, is determined by gas dynamics calculations. The method may further comprise: (f) providing a plurality of electrodes disposed within the mixing chamber between the plurality of inlets and the ion transfer tube; and (g) providing a power supply configured to supply a respective DC voltage to each one of the plurality of electrodes, wherein the DC voltages are configured to urge charged particles towards the ion transfer tube.

In accordance with a third aspect of the present teachings, a mass spectrometry system comprises: a sample supply line configured to supply a continuous flow of liquid sample at a supply-line volumetric flow rate; a flow distributor configured to receive the flow of the liquid sample at an input port thereof and further configured to divide the flow into N equal portions, each portion delivered to a respective one of N output ports of the flow distributor at a flow rate of substantially 1/N of the supply-line volumetric flow rate; a plurality of N distribution lines, each line configured to receive a respective one of the N equal flow portions from a respective one of the output ports; a plurality of N electrospray emitters, each electrospray emitter configured to receive a respective one of the N equal flow portions from a respective one of the distribution lines and to emit, from a respective emission tip thereof, a spray jet comprising charged particles generated from the respective flow portion and gas, wherein each emission tip is disposed at a distance of at least 3 mm from every other emission tip; a mixing chamber; a plurality of N inlets, each inlet configured to receive the spray jet emitted from a respective one of the electrospray emitters and to transfer the received spray jet into the mixing chamber; an outlet tube configured to transfer a mixture of the charged particles of the plurality of spray jets to an evacuated chamber of a mass spectrometer, the evacuated chamber maintained at a pressure of 1-5 Torr; and a heater thermally coupled to the outlet tube.

DETAILED DESCRIPTION

Figure 1:
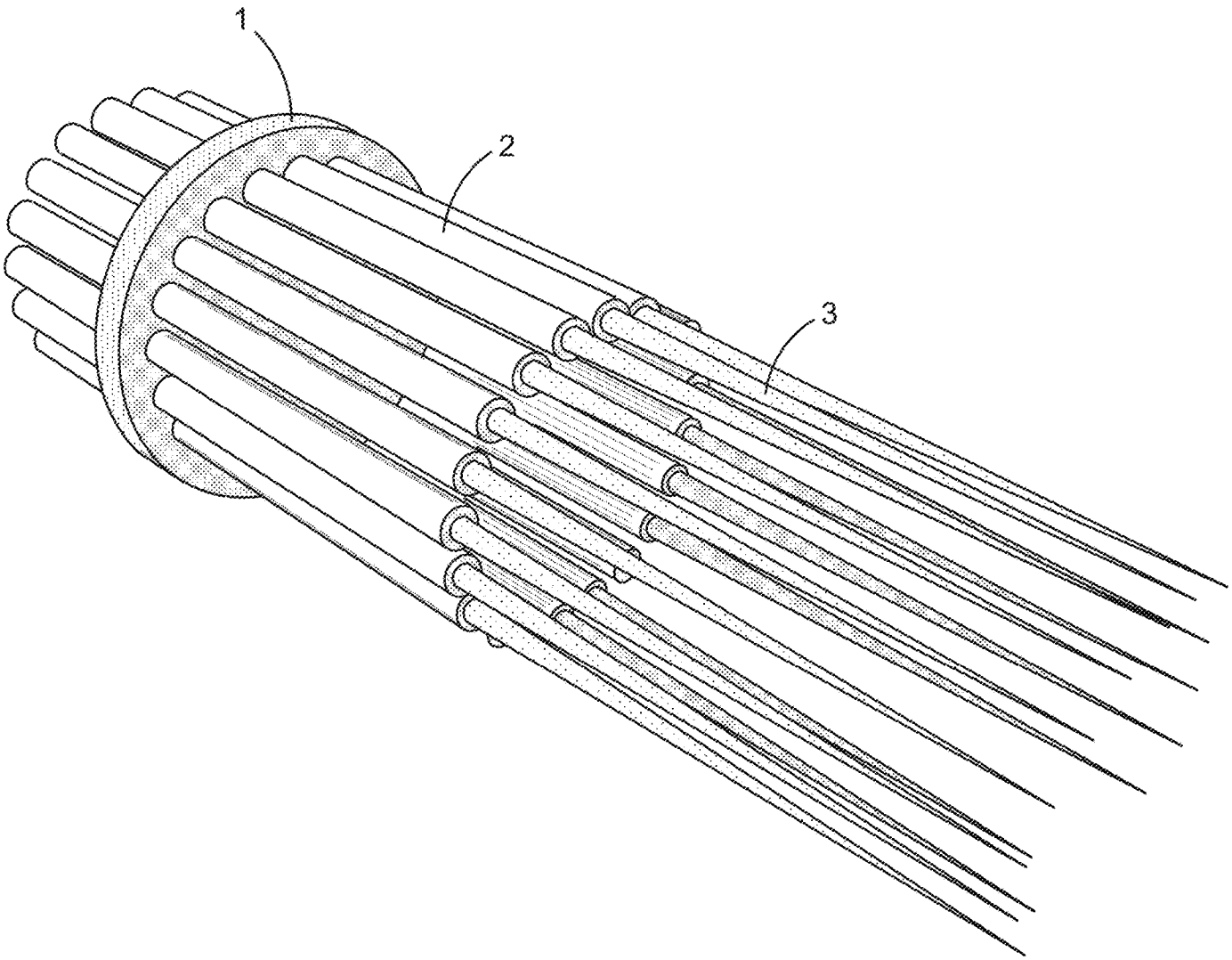
FIG. 1 (Prior Art)
FIG. 1 is an illustration of an array of fused-silica capillary nano-electrospray ionization emitters, according to a known configuration.

The present invention provides methods and apparatus for an improved multi-electrospray ionization source for mass spectrometry. The following description is presented to enable one of ordinary skill in the art to make and use the invention and is provided in the context of a particular application and its requirements. It will be clear from this description that the invention is not limited to the illustrated examples but that the invention also includes a variety of modifications and embodiments thereto. Therefore, the present description should be seen as illustrative and not limiting. While the invention is susceptible of various modifications and alternative constructions, it should be understood that there is no intention to limit the invention to the specific forms disclosed. On the contrary, the invention is to cover all modifications, alternative constructions, and equivalents falling within the essence and scope of the invention as defined in the claims. To more particularly describe the features of the present invention, please refer to the attached FIGS. 1-8, taken in conjunction with the discussion below.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. In addition, reference numerals may be repeated among the various figures to show corresponding or analogous elements. Additionally, it will be understood that any list of such candidates or alternatives is merely illustrative, not limiting, unless implicitly or explicitly understood or stated otherwise.

As used herein, the term "DC", when referring to a voltage applied to one or more electrodes of a mass spectrometer component (such as an ion funnel), does not necessarily imply the imposition of or the existence of an electrical component through those electrodes but is used only to indicate that the referred-to applied voltage either is static or, if non-static, is non-oscillatory and non-periodic. The term "DC" is thus used herein to distinguish the referred-to voltage(s) from applied periodic oscillatory voltages, which themselves may be referred to as either "RF" or "AC" voltages. As used herein, the term "inlet" refers to an aperture, which may be a lumen of a tube, at which at least sample-derived matter and possibly other matter, such as solvent-derived matter or gas, is transferred from an ion source of a mass spectrometer to other portions of the mass spectrometer.

As used herein, the term "emitter" refers to any electrospray emitter that, in operation, is used to generate ions from a liquid sample that is introduced into the emitter. This definition excludes so-called "dry" emitters that, in operation, do not provide ionized sample but are, instead, employed only to control the form of an electric field that is used to influence the emission characteristics of other adjacent emitters that do emit ionized sample. The term "integral", when used herein to refer to an integral device component, is used to indicate that the component is either formed seamlessly from a single material or else that the component is formed of a plurality of separate parts that are fastened together such that, in operation, gas and charged particles are unable to flow through any seams that may exist between the parts. The seamless fabrication of an integral component from a single material may include one or more of the processes of three-dimensional printing, cutting, engraving, shaping, grinding, drilling, milling, pressing, stamping, casting, fusing, injection moulding, physical etching, chemical etching, electrical discharge machining, etc. The fastening of separate parts may include the use of one or more of screws, pins, clips, glues, epoxies, etc. or may employ the one or more of the processes of welding, fusing, sintering, soldering, etc. The terms "tube section" and "intermediate section" are used herein to refer to various portions of an integral device component, as defined above. Note, however, that the term "cross-section" is used herein in its conventional and ordinary sense. The term "tube", when used in the absence of the word "section", refers to a detached tube that is neither a part of nor fastened to another tube or chamber.

Unless otherwise defined, all other technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present description, such that slight and insubstantial deviations are within the scope of the present teachings. In this application, the use of the singular includes the plural unless specifically stated otherwise. In addition, the use of "comprise", "comprises", "comprising", "contain", "contains", "containing", "include", "includes", and "including" are not intended to be limiting. As used herein, "a" or "an" also may refer to "at least one" or "one or more." Also, the use of "or" is inclusive, such that the phrase "A or B" is true when "A" is true, "B" is true, or both "A" and "B" are true.

Figure 3A:
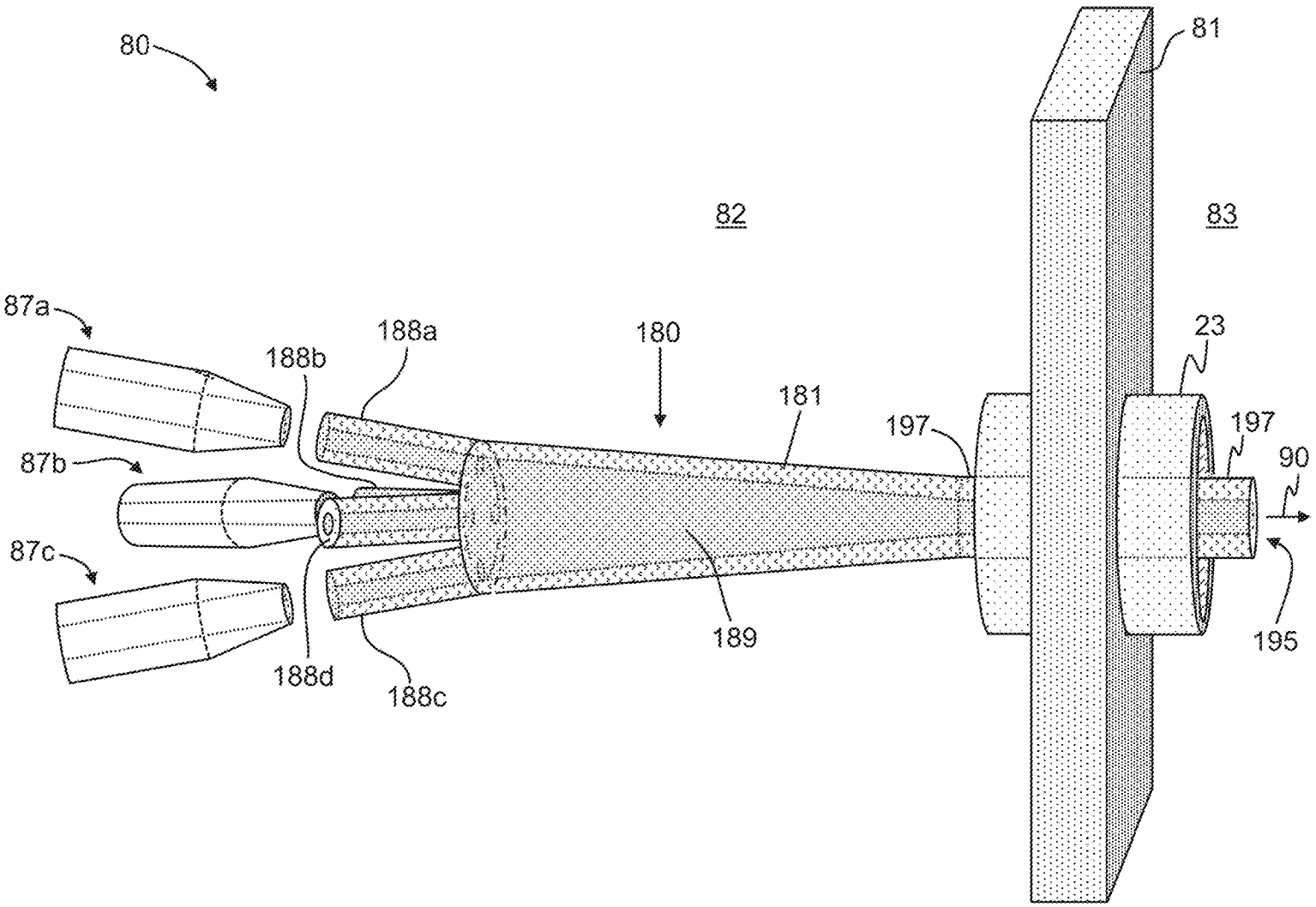
FIG. 3A is a schematic perspective depiction of a multi-electrospray ion source system and inlet system comprising multiple electro spray emitters and multiple inlets in accordance with the present teachings.

FIG. 3A is a schematic perspective depiction of a multi-electrospray ion source and inlet system in accordance with the present teachings. The system 80 illustrated in FIG. 3A includes a plurality of electrospray emitters which, in the example of FIG. 3A, consist of the four individual electrospray emitters 87*a*-87*d* (see also FIGS. 4-5) within ionization compartment 82, each emitter comprising a capillary having a nozzle end (e.g., nozzle ends 93*a*-93*d*) from which a respective spray jet (e.g., spray jets 4*a*, 4*b*, 4*c* and 4*d*) of gas and charged droplets is emitted. It should be noted, with regard to the system depicted in FIG. 3A, that the long axes of electrospray emitters 87*a* and 87*c* are parallel to the plane of the drawing, whereas emitter 87*b* is disposed at an angle to the plane of the drawing. Emitter 87*d* is not depicted in FIG. 3A because its depiction would otherwise obscure the view of the emitter 87*b*.

The system 80 (FIG. 3A) further includes a multi-inlet ion transfer tube 180 that is partly disposed within an ionization compartment 82 and partly disposed within an intermediate-vacuum compartment 83. In the system illustrated in FIG. 3A, the multi-inlet ion transfer tube 180 is a single, integral component that includes a plurality of inlet tube sections 188*a*-188*d*, with each inlet tube section of length, $L_1$, and having a lumen of constant diameter, $d_1$, (see FIG. 3B) that is configured to intercept a spray jet from a respective one of the electrospray emitters 87*a*-87*d*. The multi-inlet ion transfer tube 180 further comprises an outlet tube section 197 that has length, $L_3$, and lumen diameter, $d_3$, (FIG. 3B) that passes from ionization compartment 82 to intermediate-vacuum compartment 83 through a wall or partition 81. The outlet tube section 197 comprises an outlet port 195 that delivers ions into the intermediate-vacuum chamber 83. The multi-inlet ion transfer tube 180 further comprises an intermediate section 181 of length, $L_2$, that is integral with each of and disposed between the inlet tube sections 188*a*-188*d* and the outlet tube section 197. The intermediate section 181 comprises an internal chamber 189 that is configured to receive the effluent from all of the inlet tube sections 188*a*-188*d* and to funnel the combined material of the combined effluents into the lumen of the outlet tube section 197.

The lumen diameter, $d_3$, of the outlet tube section 197 is sufficiently small such that the lumen serves as a gas-flow restrictor that permits the compartments 82, 83 to be maintained at different pressures during operation by differential gas pumping. Typically, the ionization compartment 82 is at atmospheric pressure while the intermediate-vacuum compartment 83 is maintained at a pressure of approximately 1-5 Torr. A sub-atmospheric pressure gradient exists within the chamber 189 across its length $L_2$. At the same time, the diameter, $d_3$, of the lumen of the outlet tube section 197 is sufficiently large to be able to transfer substantially the entire combined volumetric flow rate of all inlets (e.g., each and every one of inlet tube sections 188*a*-188*d* in the illustrated example).

Each one of the inlet tube sections 188*a*-188*d* is fluidically coupled to a respective one of the electrospray emitters 87*a*-87*d* and comprises an electrode that serves as a counter electrode to a high voltage electrode of the electro spray emitter to which that inlet is fluidically coupled. A voltage difference between the emitter electrode and the counter electrode, as provided by the power supply 31 (see FIG. 2 or FIG. 7) serves to propel charged particles (droplets or free ions) from the emitter to the inlet across the associated gap. For example, if the emitter electrode is maintained at a high-magnitude positive voltage, then the inlet counter electrode may be at or near ground potential so as to urge positively charged particles from the emitter to the inlet. Alternatively, if the emitter electrode is maintained at high-magnitude negative voltage then negative ions will be attracted to the inlet electrode that is at or near ground potential. As a yet further alternative, the emitter may be maintained at or near ground potential while the inlet electrode is maintained at high voltage (either positive or negative).

Figure 3B:
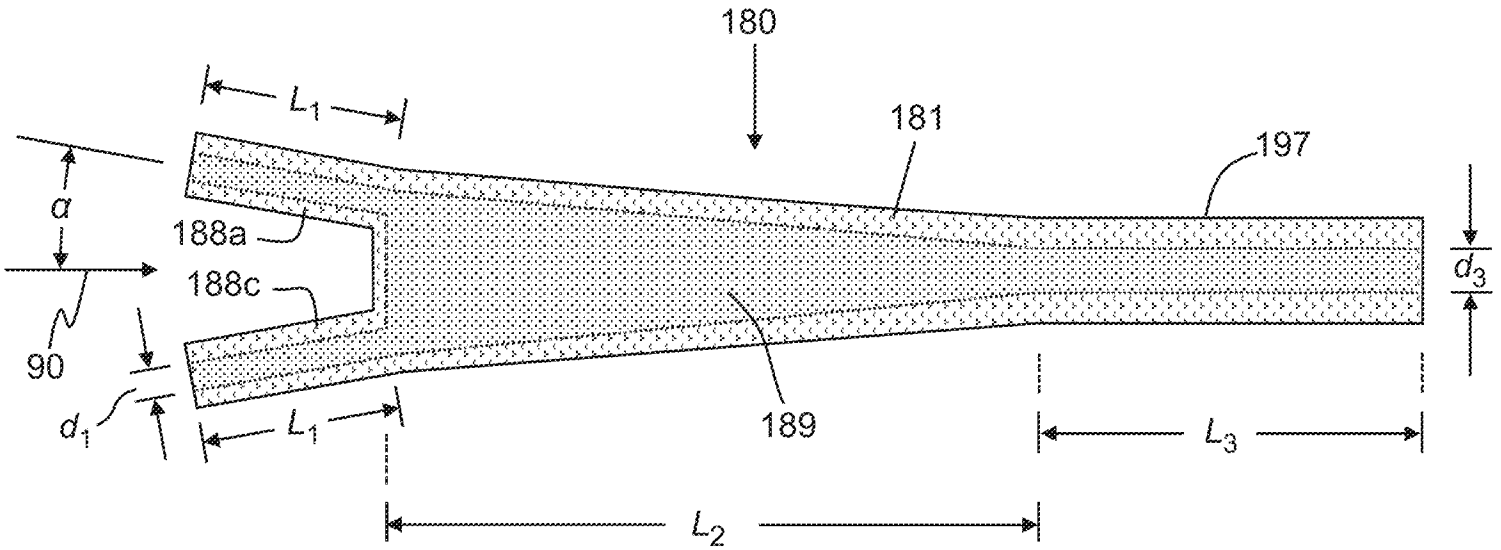
FIG. 3B is a cross-sectional view of a multi-inlet ion transfer tube of the multi-electrospray ion source system and inlet system of FIG. 3A.
Figure 3C:
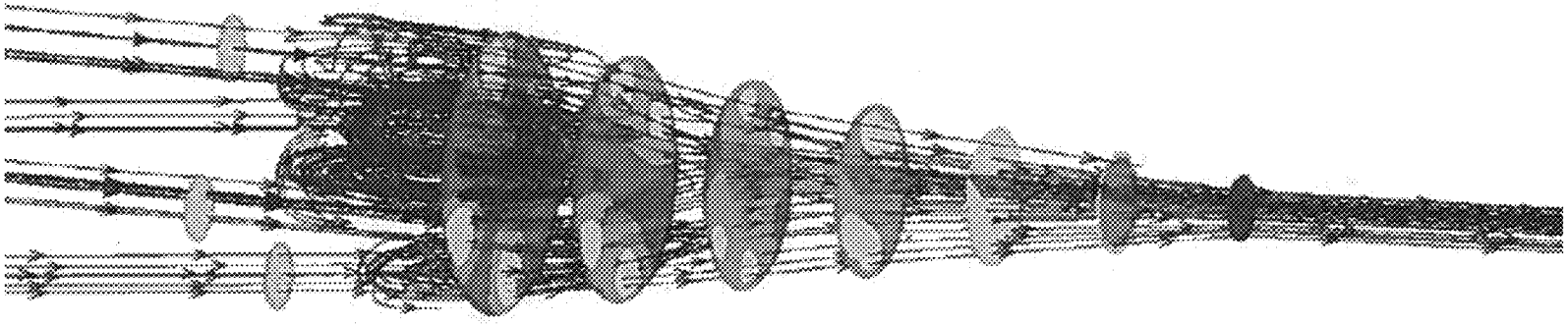
FIG. 3C is a depiction of calculated flow patterns, as determined from computational gas dynamics calculations, within the multi-inlet ion transfer tube of FIG. 3B.

The multi-inlet ion transfer tube 180 comprises a central longitudinal axis 90 that is coaxial with the lumen of the outlet tube section 197. The arrow appended to the axis 90 indicates the general direction of fluid flow through the multi-inlet ion transfer tube 180. The central longitudinal axes of the lumens of the inlet tube sections 188*a*-188*d* are generally non-coincident with and non-parallel to the axis 90. In the illustrated system 80 of FIG. 3A, all of the longitudinal axes of the lumens of the inlet tube sections are disposed at the same non-zero angle, $\alpha$, relative to the axis 90. Using gas dynamics calculations, the angle, $\alpha$, as well of the various dimensions identified in FIG. 3B have been optimized. With the optimized parameters, the results of the gas dynamics calculations show that there is significant turbulence within the internal chamber 189, as depicted in FIG. 3C. This turbulence essentially completely mixes the effluent from all of the inlet tube sections.

At least a portion of the outlet tube section 197 is thermally coupled to a heater 23 that may be disposed within either or both of the ionization compartment 82 and the intermediate-vacuum compartment 83. The heater may be further extended in the direction of the electrospray emitters whereby it may also be in thermal contact with the intermediate section 181 and/or the inlet tube sections 188*a*-188*d*. In operation, the heater 23 provides heat to gas and entrained particles within the multi-inlet ion transfer tube 180 so as to aid in evaporation of solvent and desolvation of charged droplets so as to thereby release free ions.

Figure 3D:
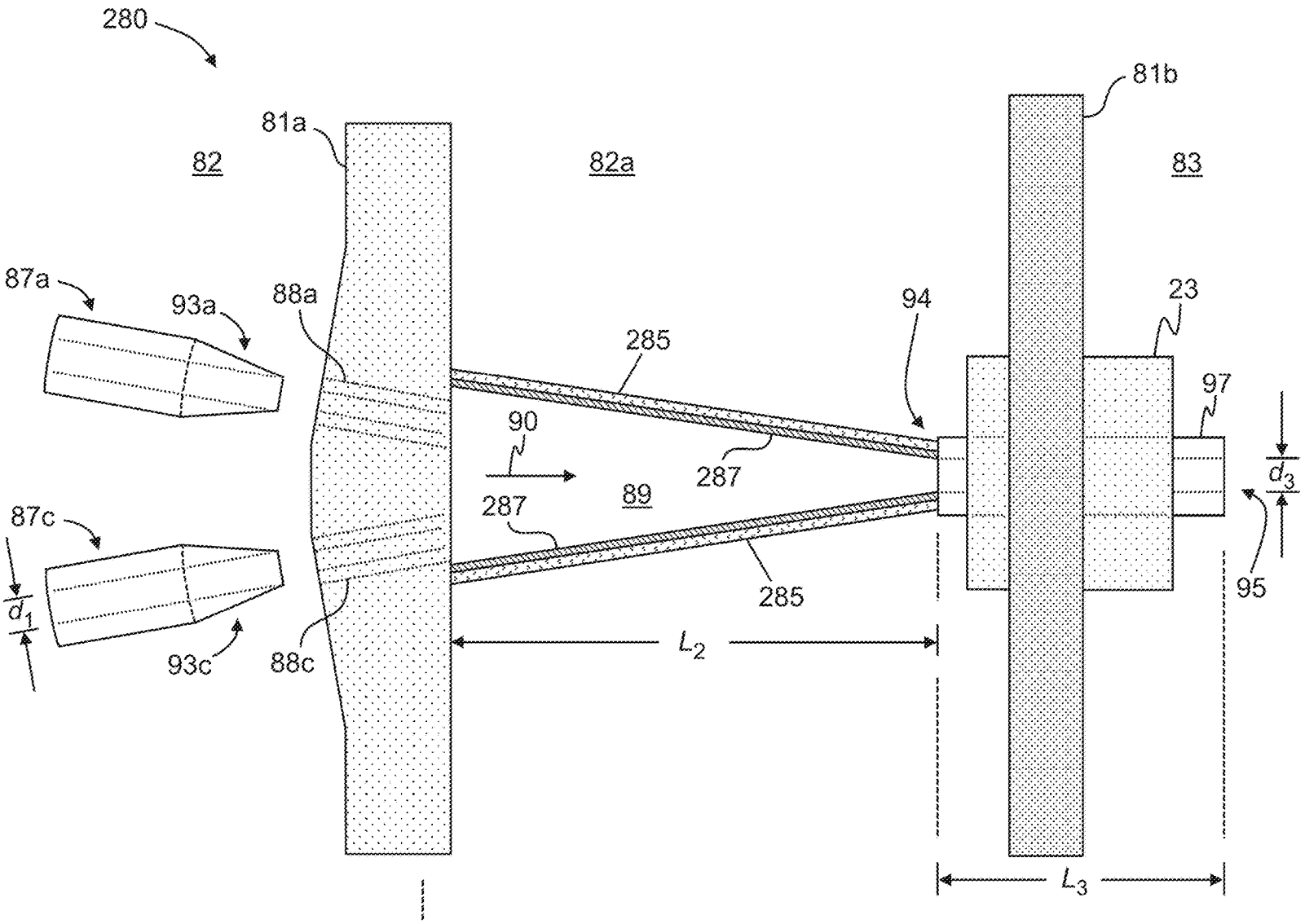
FIG. 3D is a schematic cross-sectional depiction of a multi-electrospray ion source and inlet system comprising multiple electrospray emitters and a separate funnel chamber and a separate outlet tube according to a second embodiment of the present teachings.

FIG. 3D is a schematic cross-sectional depiction of another multi-electrospray ion source and inlet system 280 in accordance with the present teachings. In contrast to the system 80 shown in FIG. 3A, the system 280 comprises a plurality of separate inlet tubes 88*a*-88*d* (see, also, FIG. 5 and FIG. 6) and a separate outlet tube 97 which are configured, relative to one another, in a configuration that is similar to the configuration of the inlet tube sections 188*a*-188*d* and the outlet tube section 197 of FIG. 3A. Also, the single wall or partition 81 of the system 80 (FIG. 3A) is replaced, in the system 280, by two separate walls or partitions 81*a*, 81*b*, thereby defining another compartment 82*a* between the ionization compartment 82 and the intermediate-vacuum compartment 83. A central axis 90 of the system 280 is coincident with a central axis of the lumen of the ion outlet tube 97. The cross section of FIG. 3D is taken in a plane that includes the central longitudinal axis 90. Accordingly, although the system 280 includes four emitters and four inlet tubes, only two emitters and two inlet tubes are depicted in FIG. 3D.

Figure 5:
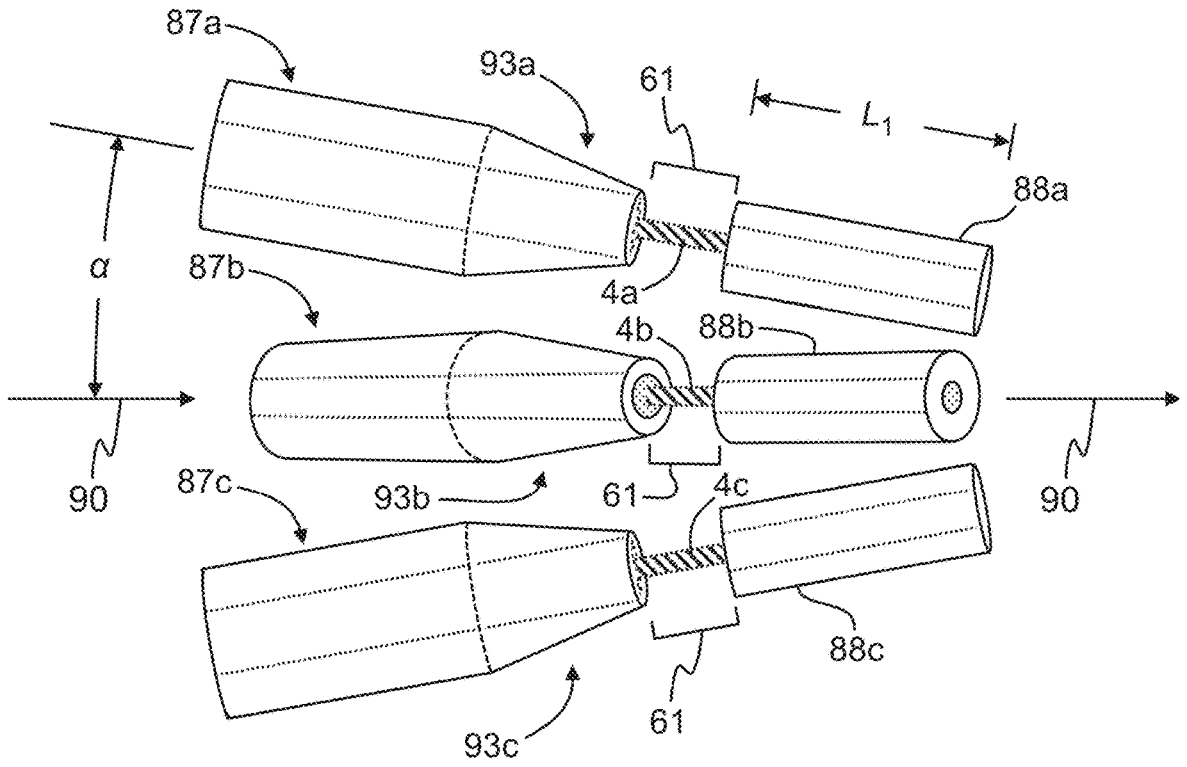
FIG. 5 is a schematic perspective depiction of multiple electrospray emitters (only three of four of which are shown) and multiple inlets (only three of four of which are shown) to which the emitters are fluidically coupled in accordance with the present teachings.
Figure 6:
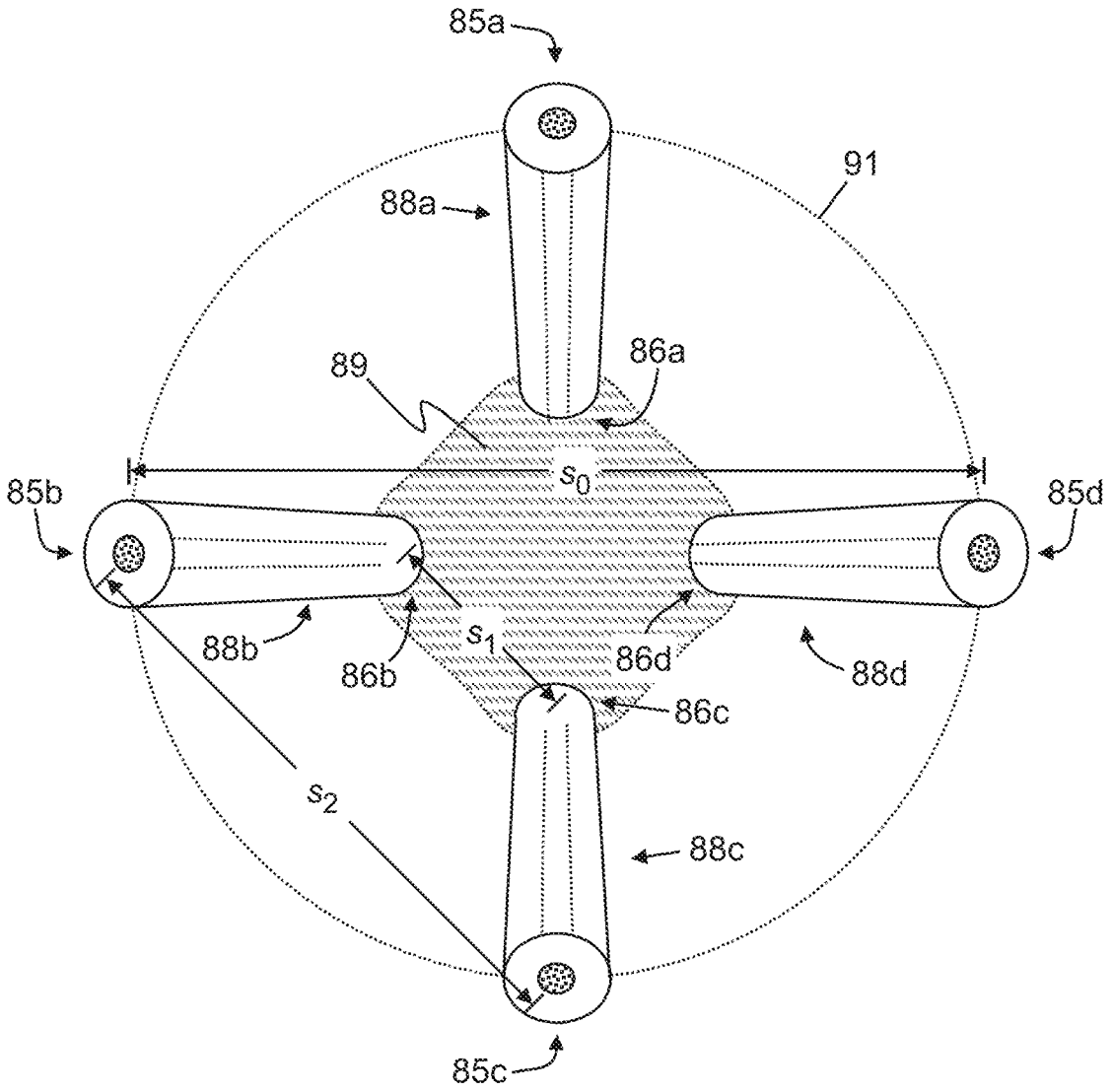
FIG. 6 is a schematic perspective view of an array of four inlets of a multi-electrospray ion source system in accordance with the present teachings, as viewed in a direction away from the source of ions along a longitudinal axis of symmetry of the system.

Each of the inlet tubes 88*a*-88*d* comprises either a capillary tube or, alternatively, a bore that passes through the wall or partition 81*a*. Each inlet tube is fluidically coupled to a respective one of the electrospray emitters and is separated from the nozzle of the respective emitter by a gap (e.g., gaps 61 as shown in FIG. 5). Referring to FIG. 6, each inlet tube comprises a respective intake end (e.g., intake ends 85*a*-85*d*) that receives a portion of gas and charged particles emitted from a respective electrospray emitter nozzle and a respective outflow end (e.g., outflow ends 86*a*-86*d*). Each outflow end discharges (i.e., emits) the gas and charged particles into a funnel chamber 89 of an intermediate tube 285 of length, $L_2$, that is disposed between the inlet tubes 88*a*-88*d* and the outlet tube 97. The long dimension of, $L_1$, of each inlet and its respective emitter is disposed at a non-zero angle, $\alpha$, relative to the longitudinal axis 90 of the system 280 (FIG. 5). The lumen diameters, $d_1$ and $d_3$, of the inlet tubes 88*a*-88*d* are defined similarly to the lumen diameters of the inlet tube sections 188*a*-188*d* (FIGS. 3A-3B) of the multi-inlet ion transfer tube 180. Likewise, the tube lengths, $L_1$, $L_2$, and $L_3$, are defined similarly to the respective lengths of the inlet tube sections 188*a*-188*d*, the intermediate section 181 and the outlet tube section 197 of the multi-inlet ion transfer tube 180.

Each one of the inlet tubes 88*a*-88*d* (see, also, FIG. 5 and FIG. 6) comprises an electrode that serves as a counter electrode to a high voltage electrode of the electrospray emitter to which that inlet is fluidically coupled. A voltage difference between the emitter electrode and the counter electrode, as provided by the power supply 31 (see FIG. 2 or FIG. 7) serves to propel charged particles (droplets or free ions) from the emitter to the inlet across the associated gap. For example, if the emitter electrode is maintained at a high-magnitude positive voltage, then the inlet counter electrode may be at or near ground potential so as to urge positively charged particles from the emitter to the inlet. Alternatively, if the emitter electrode is maintained at high-magnitude negative voltage then negative ions will be attracted to the inlet electrode that is at or near ground potential. As a yet further alternative, the emitter may be maintained at or near ground potential while the inlet electrode is maintained at high voltage (either positive or negative).

Still with reference to FIG. 3D, the outlet tube 97 is fluidically coupled to all of the inlet tubes 88*a*-88*d* by means of the funnel chamber 89 of the intermediate tube 285. The outlet tube 97 comprises an intake end 94 that is within the confines of the compartment 82*a* and an outflow end 95 that is within the confines of an intermediate-vacuum compartment 83, the two compartments being separated by wall or partition 81*b*. The outlet tube 97 comprises a capillary having a lumen diameter, $d_3$, that is sufficiently small such that the lumen serves as a gas-flow restrictor that permits the compartments 82*a*, 83 to be maintained at different pressures by differential gas pumping during operation. Typically, the ionization compartment 82 and the mixing compartment 82*a* are at atmospheric pressure while the intermediate-vacuum compartment 83*b* is maintained at a pressure of approximately 1-5 Torr. A sub-atmospheric pressure gradient exists within the funnel chamber 89 across its length $L_2$. At the same time, the diameter, $d_3$, of the lumen of the outlet tube 97 is sufficiently large to be able to transfer substantially the entire combined volumetric flow rate of all inlets (e.g., each and every one of inlet tubes 88*a*-88*d* in the illustrated example) into the intermediate-vacuum compartment. The lumen diameters, $d_1$ and $d_3$, the distances and lengths, $L_1$, $L_2$ and $L_3$, as well as angle, $\alpha$, (see FIG. 3D and FIG. 5) are all defined and determined as discussed above with regard to FIG. 3A. The calculated parameters are optimized to ensure that a substantially homogenous mixture of the effluent from all of the inlets is received by and emerges from the outflow end of the outlet tube 97.

The system 280 further comprises at least one heater 23 that is in thermal contact with the outlet tube 97 and that may optionally extend into the chamber 82*a* so as to be in direct thermal contact with at least a portion of the intermediate tube 285. The provided heat promotes evaporation of solvent from the droplets and thereby facilitates the liberation of ions of analyte compounds.

The intermediate tube 285 of the ion source system 280 (FIG. 3D) may include at least one resistive member 287 comprising a resistive material, in other words, a material comprising a greater resistivity than a metal but greater conductivity than an insulator material. The resistive material may comprise any one of a number of materials (e.g., without limitation, glasses doped with one or more metals or metal oxides, cermets, polymers, bulk metal oxides, ferrite compounds, etc.). In some embodiments, the bulk structure of the intermediate tube 285 may be formed of the resistive material, in which cases, there may be no additional resistive member or members 287. Alternatively, resistive member or members 287 may comprise an additional layer or coating of a resistive material that is either adjacent to or applied to the body of the intermediate tube 285 as depicted in FIG. 3D.

The resistive member or members 287 (FIG. 3D), if present, is/are disposed generally between the two end walls 81*a*, 81*b*. A first electrode or electrodes (not illustrated) is/are in contact with the resistive material at a location that is proximal to or on the wall 81*a* and a second electrode or electrodes is/are in contact with the resistive material at a location that is proximal to or on the wall 81*b*. A voltage difference that is applied between the two electrodes by a power supply (not shown in FIG. 3C) can create an axial electrical field parallel to the axis 90, whereby ions are urged to migrate in a general direction away from the inlet tubes 88*a*-88*d* and towards the outlet tube 97. Although ions are generally urged in this same direction by the flow of gas that is provided by the electrospray emitters 87*a*-87*d*, the axial electric field assists in preventing local charge density buildup within turbulent eddies of the gas flow field and thereby minimizes ion losses from ion-ion repulsion.

Within both the intermediate section 181 of the multi-inlet ion transfer tube 180 of the ion source and inlet system 80 (FIG. 3A) and the intermediate tube 285 of the ion source and inlet system 280 (FIG. 3D), there is an internal chamber (i.e., chambers 189 and 89, respectively) that has a cross sectional area that progressively decreases in the general direction of fluid flow through the chamber (indicated by the arrow on the representation of axis 90). Preferably, each such chamber 189, 89 has the geometric form of a funnel. More preferably, each such chamber has the form of a doubly-truncated right circular cone whose surface (i.e., an internal surface of the intermediate section 181 or of the intermediate tube 285) smoothly merges with the surface of the lumen of the outlet tube section 197 or the outlet tube 97. In the case of the multi-inlet ion transfer tube 180, it is also preferable that the surface of the chamber 189 smoothly merges with the surfaces of the lumens of all of the inlet tube sections 188*a*-188*d*. Such smooth merging of the tube surfaces assures that there are no internal pockets within the chambers 189, 89 within which stagnant, unmixed emitter effluent could collect. Alternatively but less preferably, the intermediate section 181 and the intermediate tube 285 could be formed internal chambers 189, 89 with internal chambers whose surfaces are either not circular or are not smooth, provided that the cross sectional area of the internal chamber progressively decreases in the general direction of fluid flow.

Figure 3E:
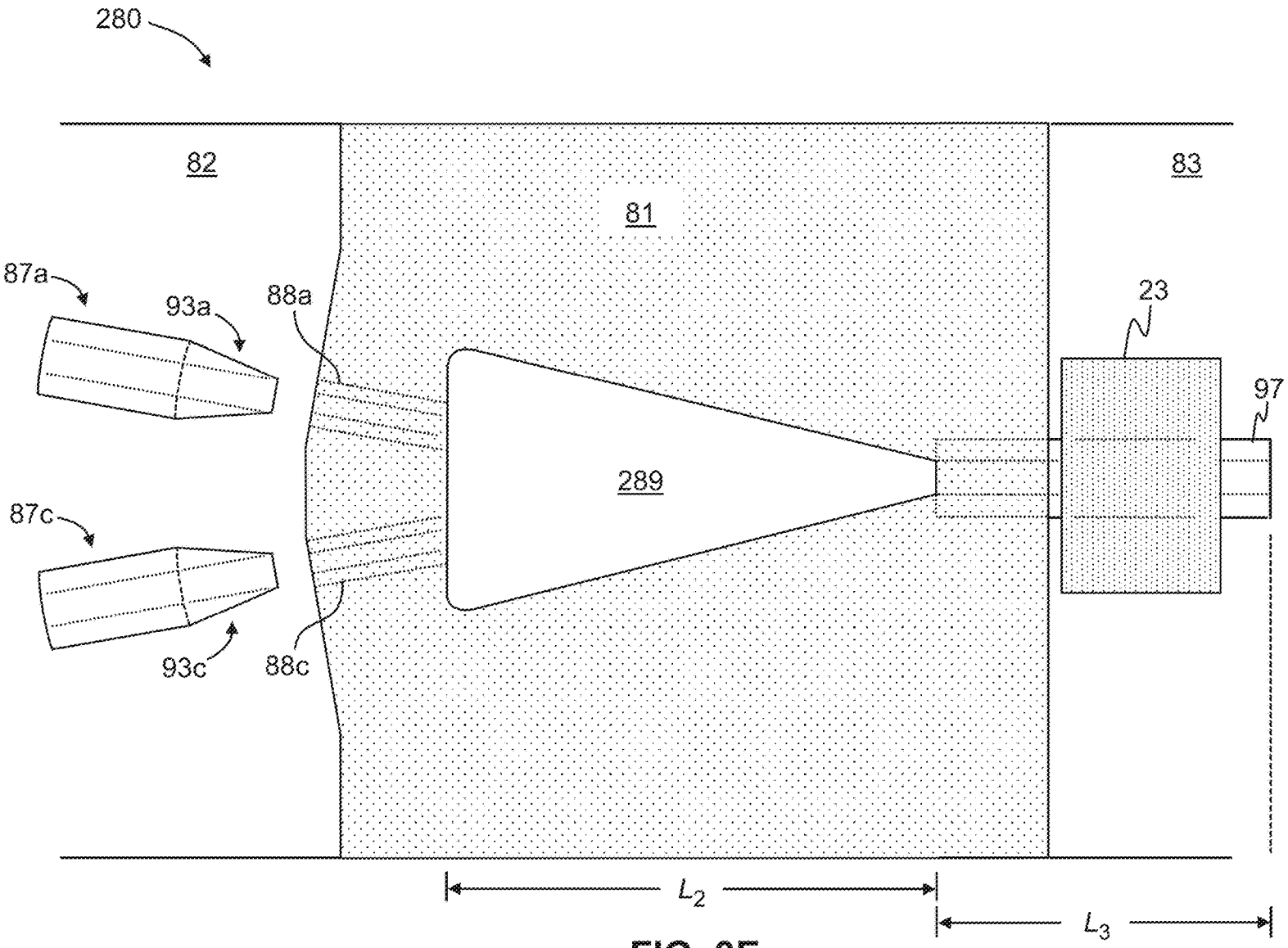
FIG. 3E is a schematic cross-sectional depiction of a multi-electrospray ion source and inlet system comprising multiple electrospray emitters, a separate funnel chamber wholly disposed within a wall or partition and a separate outlet tube according to a third embodiment of the present teachings.

FIG. 3E is a cross-sectional depiction of another, alternative multi-electrospray ion source and inlet system in accordance with the present teachings. The system 280 depicted in FIG. 3E is a variation of the already-discussed systems 80 and 180 that, in similarity to those systems, comprises an internal chamber 289 that has a cross sectional area that progressively decreases in the general direction of fluid flow through the chamber. However, in the system 280, the chamber 289 is disposed as an internal chamber that is wholly within a wall or partition 81 that separates an ionization compartment 82 at atmospheric pressure from an intermediate-vacuum compartment 83 that is maintained at a pressure of approximately 1-5 Torr. As mentioned previously, it is preferable that the internal chamber 289 has the general form of a funnel, preferably having a portion in the form of right circular cone, and having a surface the smoothly merges with the surface of the lumen of an outlet tube 97. Nonetheless, in alternative embodiments, the chamber 289 could comprise some other cross-sectional form.

Figure 3F:
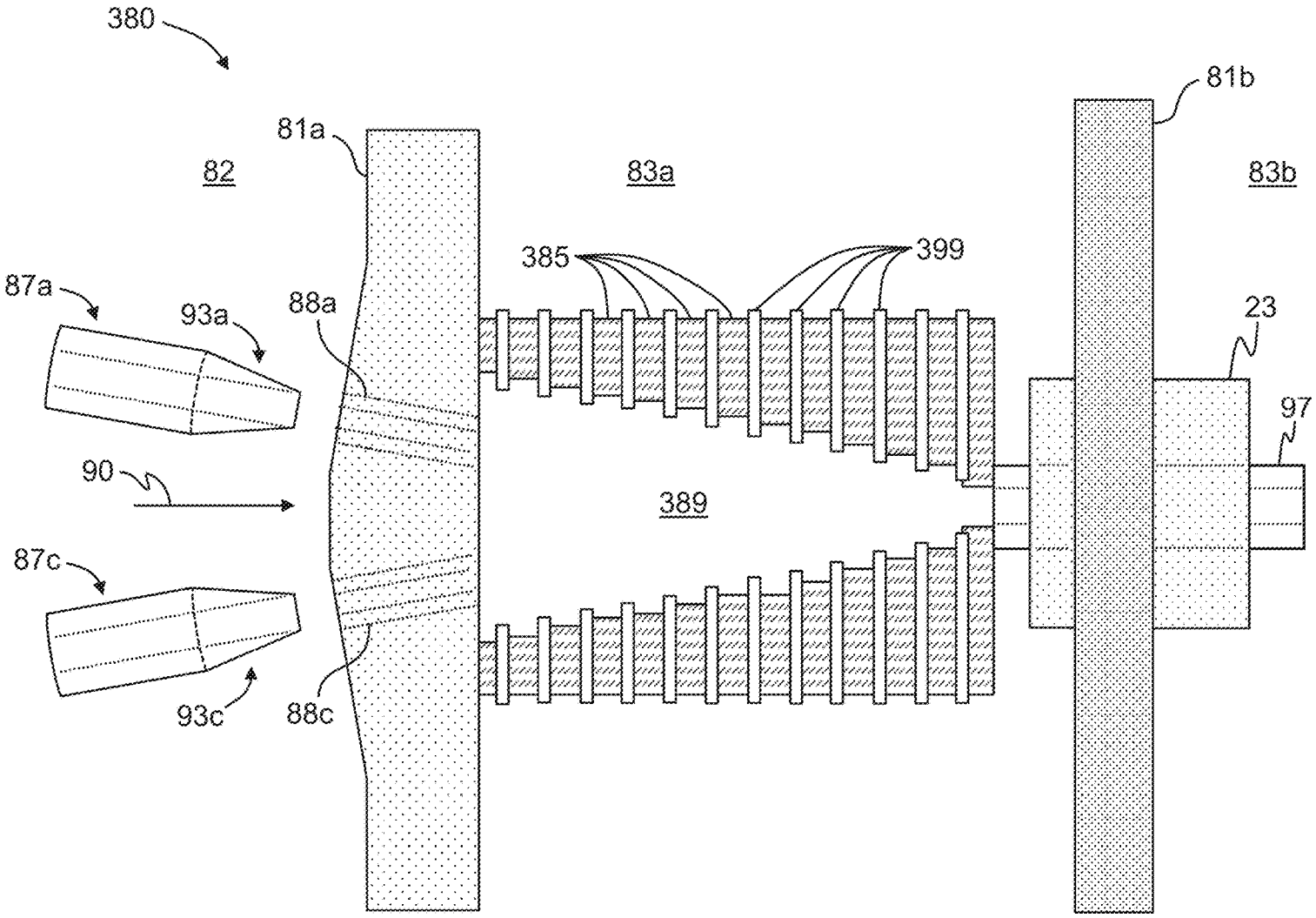
FIG. 3F is a schematic cross-sectional depiction of a multi-electrospray ion source and inlet system comprising multiple electrospray emitters, a separate chamber that is either defined by or that includes a stack of ion lenses and a separate outlet tube according to a fourth embodiment of the present teachings.

FIG. 3F is a cross-sectional depiction of another, alternative multi-electrospray ion source and inlet system in accordance with the present teachings. The system 380 comprises a chamber 389 that is either defined by or that contains a plurality of plate electrodes 399 that are separated, one from another, by insulators 385. The electrodes 399 may comprise simple ion lenses such as tube lenses or ring electrodes. In operation, a voltage provided from a power supply (not shown in FIG. 3F) is divided, in known fashion, by a voltage divider electrical configuration (not shown) that causes a respective DC voltage to be applied to each electrode 399. The voltage increments between pairs of adjacent electrodes may be either constant or non-constant. This application of a respective DC potential to each electrode causes an axial DC field gradient to be generated parallel to the axis longitudinal axis 90 of the system. The axial field is applied so as to urge ions to migrate in a general direction away from the inlet tubes 88*a*-88*d* and towards the outlet tube 97. The axial field assists in preventing lateral spreading of ions within the chamber 389 which could otherwise result from the electrostatic repulsion caused by concentration of charge density.

Figure 3G:
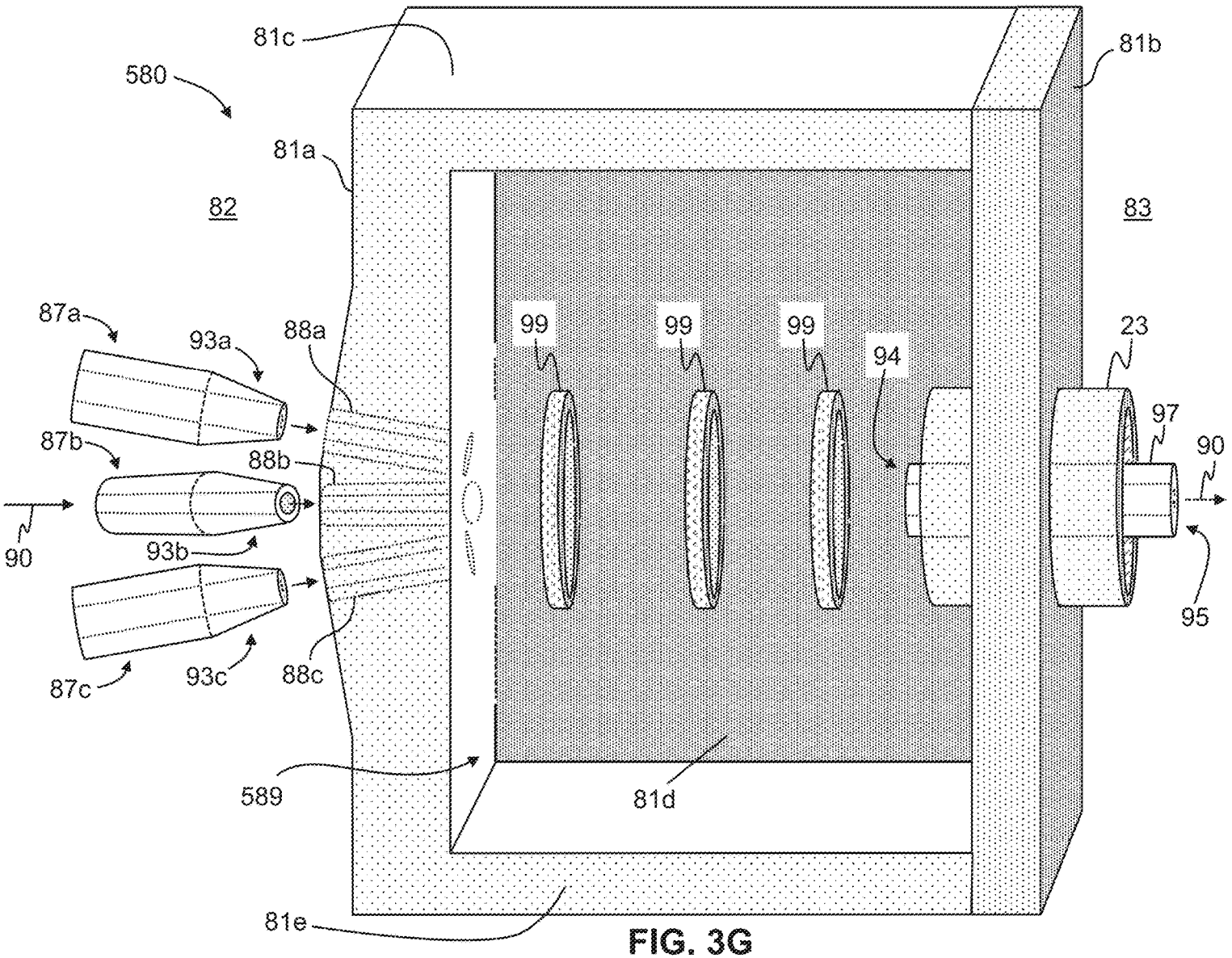
FIG. 3G is a schematic perspective depiction of a multi-electrospray ion source and inlet system comprising multiple electrospray emitters, a separate enclosed box-like chamber and a separate outlet tube according to a fifth embodiment of the present teachings.

FIG. 3G is a schematic perspective depiction of another multi-electrospray ion source and inlet system 580 in accordance with the present teachings in which an ion chamber 589 is enclosed by box-like enclosure that includes, in addition to the "end" walls 81*a* and 81*b*, a "top" wall 81*c*, a "back" wall 81*d* and a "bottom" wall 81*e*, as well as a not-illustrated "front" wall. It should be noted that the terms "front", "back", "top", "bottom", "end", "right", "left", etc., as used herein, are not intended to imply any particular spatial orientation of an actual apparatus but, rather, are used only to distinguish among the various wall elements according to the way they are displayed on the drawings. The interior surfaces of the various walls of the enclosure both define and enclose the ion chamber 589 of the system 580. The enclosure need not be in the form of a rectangular parallelepiped box as illustrated in FIG. 3G. For example, the enclosure that encloses the chamber 589 might be in the form of a hollow cylindrical tube. Optionally, a plurality of electrodes 99 may be disposed within the box-like enclosure in order to generate an axial field therein, as previously described.

Figure 4:
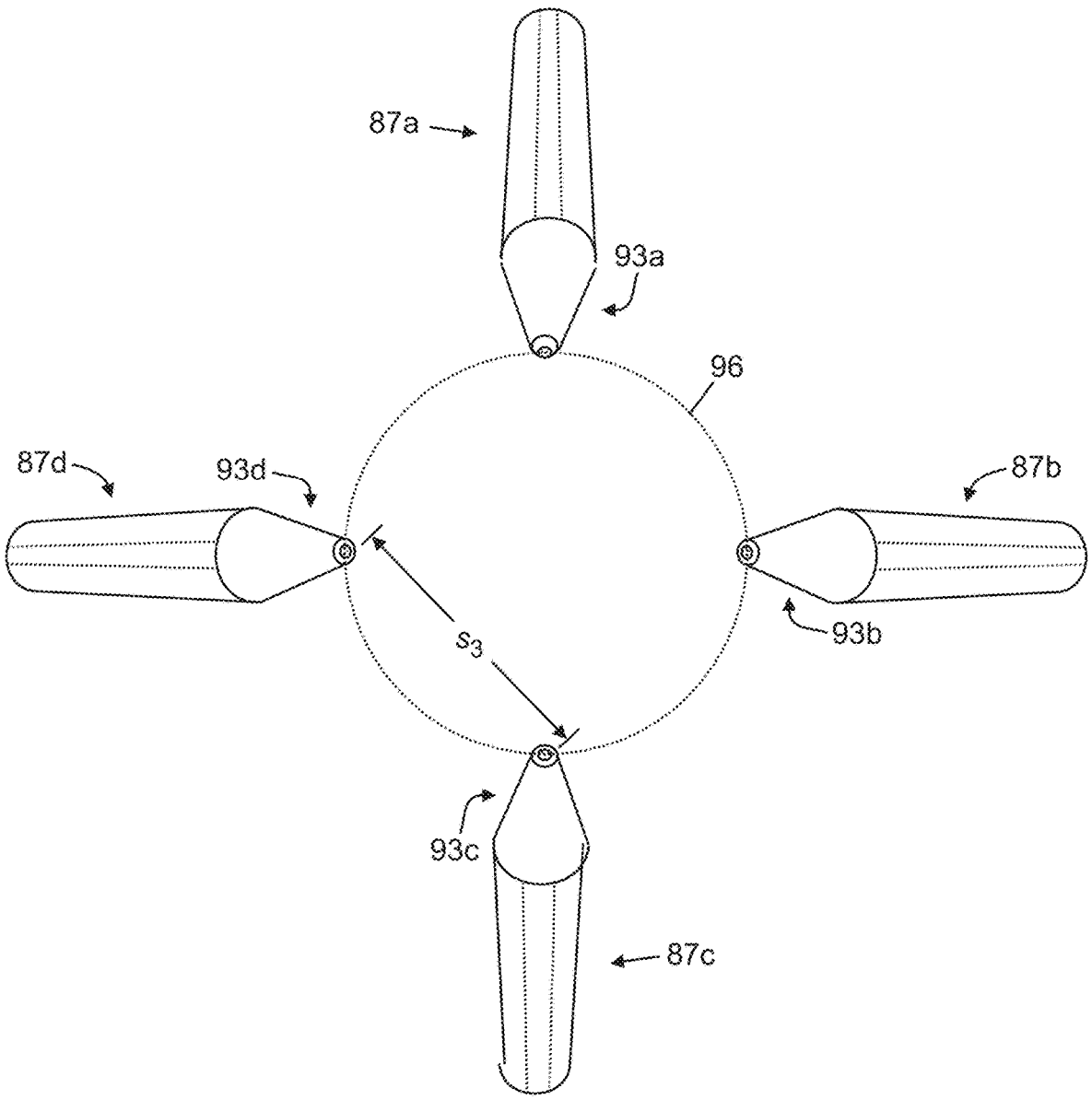
FIG. 4 is a schematic perspective view of an array of four electrospray ion emitters of a multi-electrospray ion source and inlet system in accordance with the present teachings, as viewed in a direction towards the source of ions along a longitudinal axis of symmetry of the system.

FIG. 4 is a schematic perspective view of an array of four electrospray emitters 87*a*-87*d* as viewed along the longitudinal axis of symmetry 90 in a direction towards the source of ions (i.e., opposite to the arrow attached to axis 90 in FIGS. 3A, 3B, 3D, 3F and 3G). Each electrospray emitter directs gas and charged particles to a respective one of the inlet tubes 88*a*-88*d* or inlet tube sections 188*a*-188*d* as shown in FIG. 5. Accordingly, an axis defined at the tip of each electrospray emitter aligns with the projection of the longitudinal axis of the respective inlet or inlet tube section. If all inlet tubes 88*a*-88*d* or inlet tube sections 188*a*-188*d* are disposed at a same non-zero angle, $\alpha$, relative to a longitudinal axis 90, as illustrated in the drawings, then the tips of electrospray nozzles 93*a*-93*d* all lie on a common circle 96 as shown in FIG. 4.

One consideration in the placement of the emitters 87*a*-87*d* is that, to avoid electrostatic interference between emitters, no two emitter tips should be closer than 3 mm from one another and, preferably, no two emitter tips should be closer than 5 mm from one another. Thus, with the configuration shown in FIG. 4 and with a constant angle, $\alpha$, each emitter tip should be disposed at least at a distance 61 away from the inlet tube or inlet tube section to which it supplies effluent (see FIG. 5) such that the inter-tip distance, $s_3$, is greater than at least 3 mm and, preferably, greater than 5 mm. Nonetheless, according to some alternative embodiments of ion source and inlet systems in accordance with the present teachings, not all inlet tubes or inlet tube sections are disposed at the same angle relative to the longitudinal axis of the system. In such embodiments, these angles, some of which may be zero, are adjusted in order to fulfill an inter-tip distance constraint as noted above. Such configurations may be advantageous when a loss of ion transfer efficiency, as caused by a less-than-optimal inlet angle, is outweighed by a gain in ionization efficiency caused by provision of one or more additional emitters.

FIG. 6 is a schematic perspective view of all four inlet tubes 88*a*-88*d*, all depicted as capillary tubes, that better portrays their three-dimensional disposition. The discussion below applies similarly for emitter tube sections 188*a*-188*d*. Thus, inlet tubes and inlet tube sections are here all referred to as "inlets". Specifically, FIG. 6 is a view of the inlets as viewed along a longitudinal axis of symmetry 90 (see FIGS. 3A, 3B, 3D, 3F and 3G) in a direction away from the source of ions (i.e., in the direction of the arrow on axis 90). The outflow ends (i.e., ends 86*a*-86*d*) of each pair of adjacent inlets are disposed at a constant distance, $s_1$, from one another. This separation distance is illustrated between outflow ends 86*b* and 86*c* in FIG. 6; other adjacent pairs of outflow ends of the inlets are separated by the same distance. The distance, $s_1$, is set at 1.5 mm in all cases. All of the inlets displayed in FIG. 6 are assumed to be disposed at a common pre-determined angle, $\alpha$, ($\alpha \neq 0$) relative to the axis 90 (e.g., see FIG. 5). As noted previously, the angle, $\alpha$, may be chosen in conjunction with the choosing of the distance, $L_2$, and the tube lengths, $L_1$ and $L_3$, so that a nearly completely homogeneous mixture of the material discharged from all of the electrospray emitters is delivered to the intermediate-vacuum compartment 83, 83*b* through the outlet tube 97, as determined from gas dynamics calculations. The intake ends 85*a*-85*d* of the inlets all lie on a circle 91 and there is a constant separation, $s_2$, between the intake ends of each pair of adjacent inlet tubes. With four emitters and four inlets as depicted herein, the distance so, in millimeters, between the intake ends of diametrically opposed inlets (e.g., either the pair of inlets 88*a* and 88*c* or the pair of inlets 88*b* and 88*d*) is given by $$s_0=(\sqrt{2}\times s_1)+(2L_1 \sin \propto) \quad \text{Eq. (1)}$$

where $s_1$ is 1.5 mm and $L_1$ is also given in millimeters. Accordingly, noting that the intake ends 85*a*-85*d* are disposed at the corners of a square, the distance, $s_2$, is given by $$s_2 = s_0 / \sqrt{2} = s_1 + \sqrt{2}\,(L_1 \sin \propto) \quad \text{Eq. (2)}$$

From FIG. 5, it may be observed that $s_3 \approx s_2$. Note, however, that FIGS. 4-6 are not drawn to scale; the diameter of the circle 96 (FIG. 4) is slightly greater than the diameter of the circle 91 (FIG. 5) because of a small gap 61 between each emitter and its respective inlet (i.e., the inlet to which it is fluidically coupled). Thus, the inter-emitter-tip distance, $s_3$, is slightly but not significantly greater than the distance, $s_2$, between the intake ends of adjacent inlets.

In order to optimize the configuration illustrated in FIG. 3A, the flow of gas flow emitted from four capillary inlet tube sections into a chamber and subsequently merging into a single outlet tube section was modeled by solving full three-dimensional Navier-Stokes equations by iterative finite-element numerical analysis and commencing with certain initial parameters and boundary conditions. Some parameters relating to physical hardware constraints were treated as constants. These included the inlet capillary bore diameter, which was set at a value of 0.6 mm and closest-approach distance, $s_1$, between inlet centers (FIG. 5) which was held constant at 1.5 mm. Also, the temperature, T, and pressure, P, of the ionization compartment 82 were assumed to be constant at 300 K and 1 atmosphere, respectively, while the T and P values within the intermediate-vacuum chamber 189 were assumed constant at 550 K and 2 Torr, respectively. The wall 81 was also assumed to be isothermal at 550 K. The elevated temperature of the downstream components permits modelling of the effects of the heater 23 on gas density and viscosity.

During the solving of the Navier-Stokes equations, the inlet angle, $\alpha$, was allowed to vary from iteration to iteration. Likewise, the ion transfer tube lumen diameter, $d_3$, was initially set at 1 mm; the inlet length, $L_1$, was initially set at 22.5 mm; the distance $L_2$ was initially set at 7.5 mm; and the length $L_3$ was initially set at 20 mm (see FIG. 3B). All four of these latter parameters were allowed to vary from their initial conditions. Turbulence factors were added to the model once a steady-state laminar flow solution had been found. Finally, the bore diameter, $d_3$, and other parameters were adjusted with a final value for the gas flow rate of 3300 sccm (standard cubic centimeters per minute). Only gas flow properties were considered in the model; the effects of droplet-droplet, ion-droplet and ion-ion repulsion were considered to be negligible, except possibly within the mixing zone. Such effects may be compensated by provision of electrodes or ion lenses 99, 399 as illustrated in FIGS. 3F and 3G or one or more resistive members 287 as illustrated in FIG. 3D. The optimized solution of the Navier-Stokes equations with the given boundary conditions yields the following values of the parameters: $\alpha$=10 degrees; $d_3$=1 mm; $L_1$=27 mm; $L_3$=20 mm; and $L_2$=7.5 mm. Substitution of the determined values of a and $L_1$ into Eq. (2) yields an inter-emitter separation distance of greater than 7 mm, which is expected to be sufficient to substantially eliminate inter-emitter interference.

Figure 7:
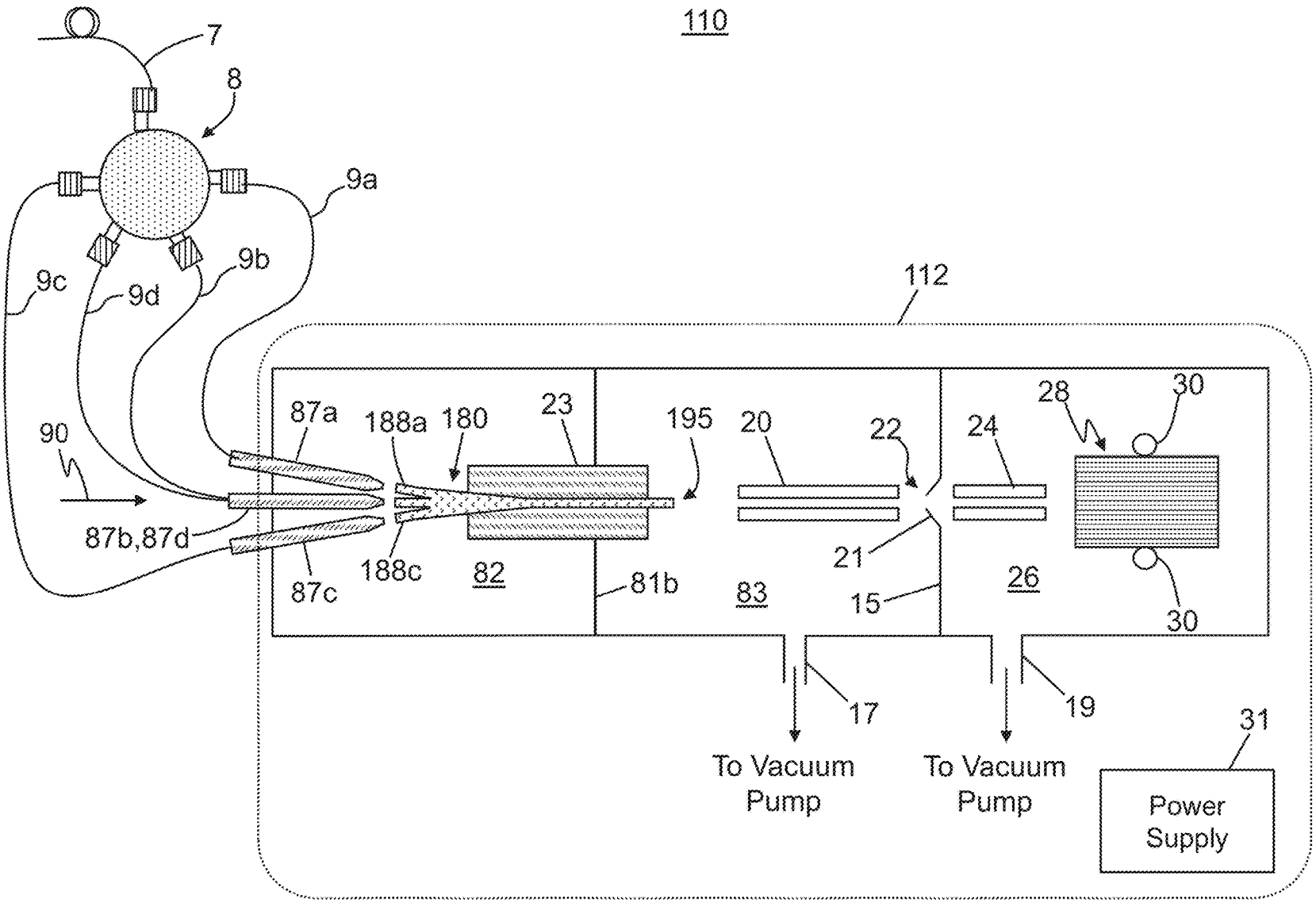
FIG. 7 is a schematic depiction of a configuration of a mass spectrometer system employing multiple electrospray emitters and a multi-segment ion transfer tube in accordance with the present teachings.

FIG. 7 is a schematic depiction of a configuration of a mass spectrometer system 110 employing multiple electrospray emitters and a multi-electrospray ion source and inlet system in accordance with the present teachings. Although FIG. 7 specifically depicts an instance of the system 80 comprising the multi-inlet ion transfer tube 180 within a mass spectrometer, other embodiments of multi-electrospray ion source and inlet systems in accordance with the present teachings could be substituted for that system. In operation of the mass spectrometer system 110, a flow of analyte-bearing liquid solution is delivered to through inlet tubing 7 to a liquid flow distributor 8. For example, the liquid flow distributor may comprise a manifold having an inlet port and a plurality of outlet ports. In the example shown in FIG. 7, the liquid flow distributor 8 comprises four outlet ports, each of which delivers a portion of the liquid flow to a respective one of a set of tubing lines 9*a*-9*d*. Each of the tubing lines delivers its liquid flow portion to a respective one of four electrospray emitters 87*a*-87*d* of mass spectrometer 112. Preferably, the liquid flow distributor 8 divides the original flow, as received from inlet tubing 7, into substantially equal proportions such that each of the tubing lines 9*a*-9*d* carries the same flow rate of eluate as every other tubing line.

Each one of the electrospray emitters 87*a*-87*d* generates a respective spray jet (not shown in FIG. 7) within the ionization compartment 82 of mass spectrometer 112. As previously described, each spray jet is intercepted by a respective one of the inlets 88*a*-88*d* and is thereby transferred into the chamber 189 of the multi-inlet ion transfer tube 180. The discharge from all of the electrospray emitters is mixed within the multi-inlet ion transfer tube 180 and the resulting flow of the mixture is delivered into the intermediate vacuum compartment 83 by the outlet tube section 197. Within the outlet tube section, the mixture comprises gas, free ions and residual charged droplets of eluate liquid. Heating of the mixture within the outlet tube section causes substantially complete evaporation of the residual liquid. The material that is discharged into the intermediate-vacuum compartment 83 thus substantially consists of only ions and neutral gas molecules. Most of the neutral gas molecules are removed through vacuum port 17 whereas the ions are guided by ion optics 20 through aperture 22 and into high vacuum compartment 26.

Figure 2:
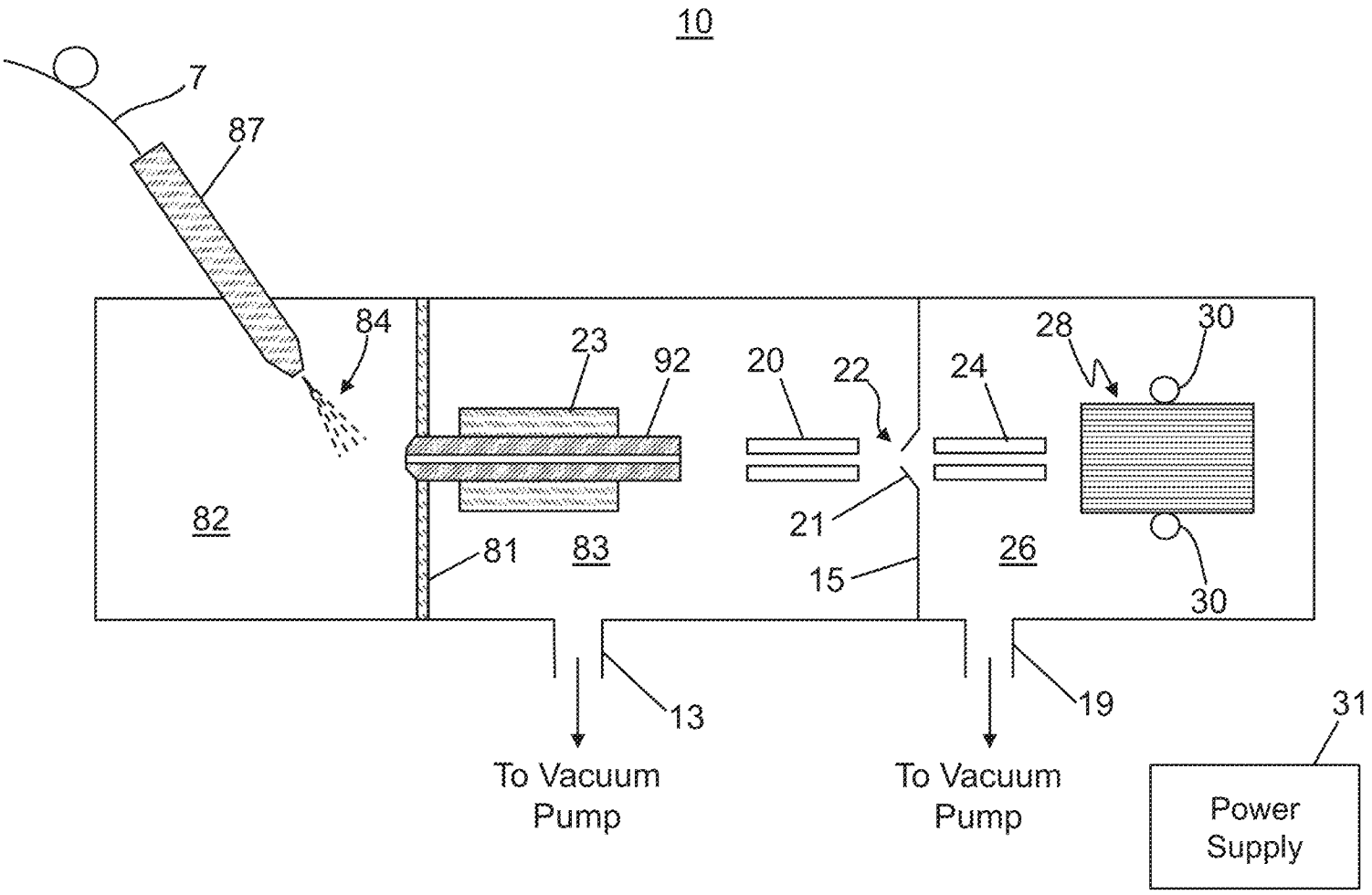
FIG. 2 (Prior Art)
FIG. 2 is a simplified schematic diagram of a general conventional mass spectrometer system comprising an electrospray ion source.

In operation of the system 110 (FIG. 7), the volumetric flow rate of material (sample derived compounds, solvent and optional sheath or carrier gas) introduced into ion transfer tube 97 is substantially identical to what it would be if only a single electrospray emitter and single ion transfer tube were employed, as in FIG. 2. Nonetheless, the total ion current, indicative of how many ions are introduced into the vacuum stages of the mass spectrometer is greater using the multi-inlet ion transfer tube than it would otherwise be using a single emitter. The increased overall ion production is attributable to the fact that the ratio of releasable ions per milliliter of sample is greater for each of the reduced-flow electrospray emitters than it would be for a single electrospray capillary carrying the total sample flow. This result is attributable to the known phenomenon of reduction in droplet size with reduction in electrospray flow rate.

Figure 8:
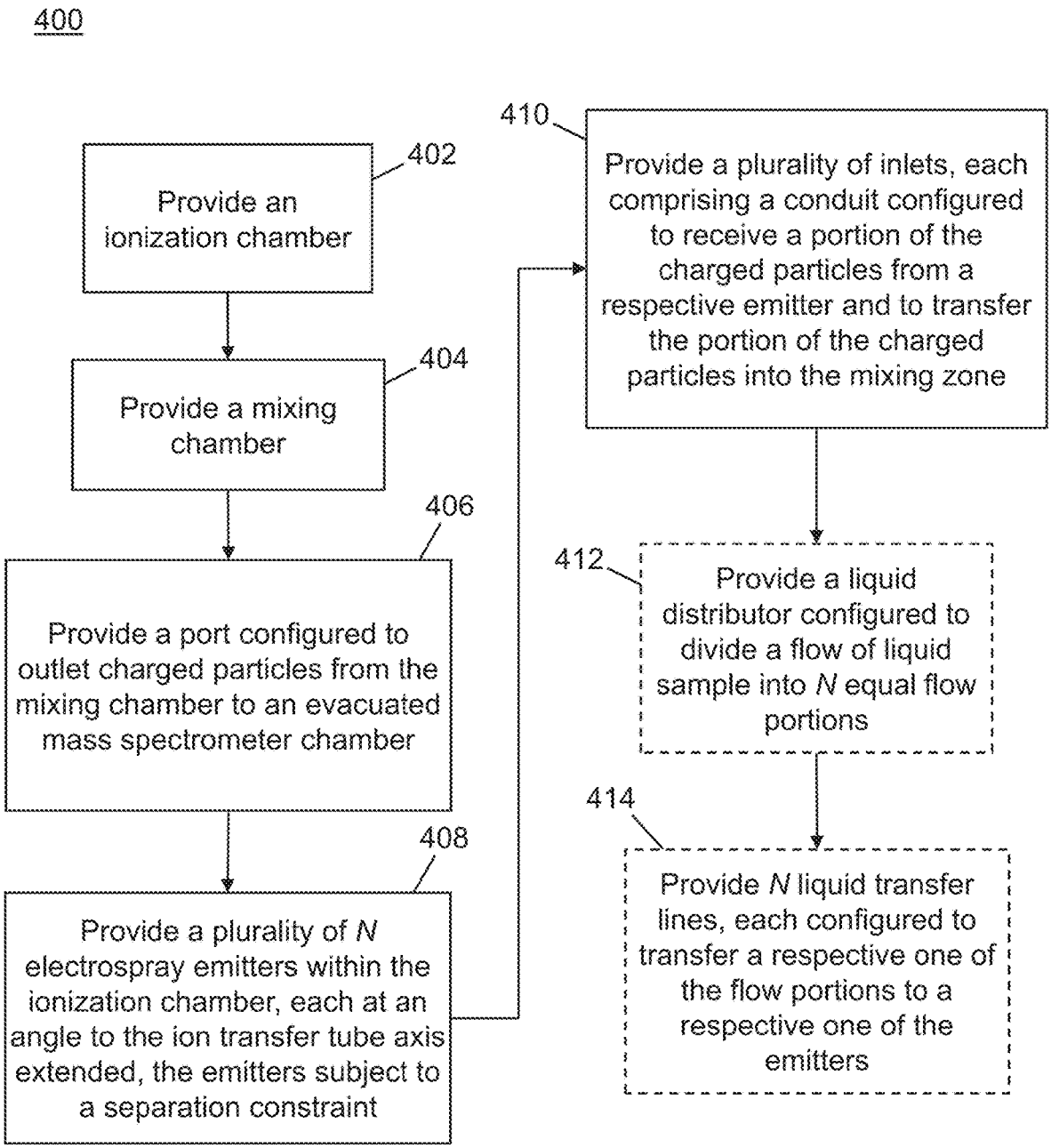
FIG. 8 is a flow diagram of a mass spectrometry method in accordance with the present teachings.

FIG. 8 is a flow diagram of a mass spectrometry method 400 in accordance with the present teachings. The method includes providing an ionization compartment (step 402), such as the ionization compartment 82 shown in FIG. 2 and FIGS. 3A-3D and providing (step 404) a mixing chamber. The mixing chamber is one or more chambers within which effluent from a plurality of electrospray emitters is combined. For example, the mixing chamber may comprise one or both of the internal chamber 189 and the lumen of the outlet tube section 197 as shown in FIGS. 3A-3B. Alternatively, the mixing may comprise one or both of the mixing chamber may comprise one or both of the funnel chamber 89 and the lumen of the outlet tube 97 shown in FIG. 3D, one or both of the an internal chamber 289 and the lumen of the outlet tube 97 shown in FIG. 3E, one or both of the chamber 389 and the lumen of the outlet tube 97 shown in FIG. 3F, or one or more of the enclosed chamber 589 and the lumen of the outlet tube 97 shown in FIG. 3G, etc. The method further includes providing (step 406) a port (e.g., the outflow end 195 of outlet tube section 197 as shown in FIG. 3A or the outflow end 95 of outlet tube 97 as shown in other figures) that is configured to outlet charged particles from the mixing chamber to an evacuated compartment of a mass spectrometer. The method still further includes providing (step 408) a plurality of N electrospray emitters within the ionization compartment (e.g., the emitters 87*a*-87*d*), each of which comprises an axis (for example, an axis of a conical nozzle portion) that is disposed at a non-zero angle, α, to the extension of a central axis of the ion transfer tube. To avoid interference between the emitters, the placement of the emitters is also subject to a separation constraint. Specifically, the emitters should be disposed such that no two emission tips (e.g., the tips, on circle 96, of nozzle ends 93*a*-93*d* as shown in FIG. 6) of the emitters are within 3 mm of one other. More preferably, the emitters should be disposed such that no two emission tips are within 5 mm of one other.

Step 410 of the method 400 comprises providing a plurality of inlets (e.g., inlet tube sections 188*a*-188*d* as shown in FIG. 3A or inlet tubes 88*a*-88*d* as depicted in other figures), wherein each inlet comprises a conduit that is configured to receive a portion of the charged particles, the portion received from a respective emitter, and to transfer the portion of the charged particles into the mixing chamber. Generally, in order to be able to receive the portion of the charged particles from the respective emitter, the longitudinal axis of each inlet should be essentially coincident with the aforementioned extension of the axis of the respective emitter. Accordingly, the longitudinal axis of each inlet is also disposed at the angle, α, with respect to the extension of the central axis of the ion transfer tube. The method 400 may terminate after step 410, since the subsequent steps 412 and 414 are optional (indicated by dashed outlines in FIG. 8).

Certain physical parameters are associated with the providing and the configuring of the various components noted in steps 404 through 410 of the method 400. The outlet tube section 197 and the ion transfer tube 97 are each associated with a length parameter and an inner diameter parameter. Likewise, the inlets 188*a*-188*d* and 88*a*-88*d* are associated with respective length and diameter parameters and also with the angle parameter, α (see FIG. 4). At least a portion of the mixing chamber is associated with a distance parameter, $L_2$, as shown in FIGS. 3B, 3D and 3E and the heater 23 is associated with a temperature parameter, T. Moreover, the system as a whole is associated with a total gas volumetric flow rate parameter, Q, and a set sub-ambient pressure, P, of an evacuated mass spectrometer compartment (e.g., compartment 83 in FIG. 7) into which de-solvated ions are to be introduced.

The above-listed parameters affect the gas dynamics of gas mixing after introduction of the electrospray emissions into the mixing chamber including the shape and size of a mixing zone within the mixing chamber. These parameters are important to consider because the initial mixing of the emission streams, within the upstream portion of the mixing zone, is largely affected by the gas dynamics properties. Once mixing has been mostly achieved, it is necessary to consider increased charge density within the downstream portion of the mixing zone. Thus, another parameter that should be considered is the nature and strength of electric field(s), if any, that should be applied by either ring electrodes 99 (FIG. 3G), resistive materials 287 (FIG. 3D) or a stack of ion lenses 399 (FIG. 3F).

For any particular mass spectrometric experimental setup, some of the above-noted parameters may be constrained by the nature of the experiment or the samples and/or by the dimensions of available components. The remaining parameters are adjustable. Adjustments of such adjustable parameters may be made to optimize one or both of: (a) the degree of mixing of the gas and particle streams and (b) the overall throughput of analyte molecules and ions through the system. Because gas dynamics considerations play a major role in the mixing of the effluent streams from multiple electrospray emitters, it is preferable for the optimization procedure to include gas mixing simulations that are performed by solving full three-dimensional Navier-Stokes equations by numerical analysis. The results of such simulations can provide a best solution for any particular set of constrained parameters and constrained boundary conditions, the latter of which may be related to apparatus geometry.

Optional step 412 of the method 400 (FIG. 8) comprises providing a liquid distributor configured to divide a flow of liquid sample into N equal flow portions as is depicted schematically in FIG. 7. The liquid distributor component 8 may be any known suitable manifold or proportioning valve or, perhaps, an assembly of multiple interconnected valves comprising multiple stages of flow splitting. Step 414 comprises providing N liquid transfer lines, such as the illustrated liquid transfer lines 9*a*-9*d*, each of which is configured to transfer a respective one of the flow portions to a respective one of the emitters.

In operation of the full system, such as the system 110 of FIG. 7, that is constructed by the practice of method 400, from step 402 through to step 414, each emitter imparts electric charge to the respective received fluid flow portion and nebulizes the flow portion so as to generate a spay jet though the introduction of a nebulizing gas. The resulting plurality of spray jets, each of which is an aerosol of gas and charged particles, are directed into an ionization compartment (e.g., ionization compartment 82) by the emitters. The spray jets are then introduced into a mixing chamber through a respective one of a set of N inlets (e.g., inlets 188*a*-188*d* or 88*a*-88*d*). Within the mixing chamber, the sample-derived aerosol components of the various spray jets are efficiently mixed together as a result of turbulence within a restricted mixing zone that is generated in accordance with the chosen configuration parameters. A substantial portion of the resulting mixed aerosol is then introduced into an evacuated mass spectrometer compartment through an outlet port (e.g., outlet ports 95, 195) that is heated by a heater (e.g., heater 23). The efficiency of the mixing and of the subsequent transfer of the resulting mixture into an ion transfer tube is in accordance with the chosen configuration parameters, as set during the configuration steps 404 through 410 of the method 400. Such configuration parameters are chosen as provided for in the above discussion relating to those steps.

The discussion included in this application is intended to serve as a basic description. The present invention is not intended to be limited in scope by the specific embodiments described herein, which are intended as single illustrations of individual aspects of the invention. Functionally equivalent methods and components are within the scope of the invention. Various other modifications of the invention, in addition to those shown and described herein will become apparent to those skilled in the art from the foregoing description and accompanying drawings. For example, although the present discussion and drawings have described mass spectrometer systems comprising exactly four emitter/inlet pairs, the invention is not intended to be limited to any particular number of emitter/inlet pairs. Either a fewer (i.e., 2 or 3) or a greater number of emitter/inlet pairs may be employed. However, with differing numbers of emitter/inlet pairs, some or all physical parameters may differ from those listed herein. Gas dynamics analyses, of the type described herein, may be employed to determine the best set of parameters for any particular number of emitters. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. An electrospray ion source for a mass spectrometer comprising:

a plurality of N electrospray emitters within an ionization compartment, wherein $N \geq 2$;

a mixing chamber;

a plurality of N inlets, each inlet comprising a conduit configured to receive charged particles from a respective one of the electrospray emitters and to emit the charged particles into the mixing chamber;

an outlet port either facing or within an intermediate-vacuum compartment; and a heater in thermal contact with at least a portion of the mixing chamber.

2. An electrospray ion source as recited in claim 1, wherein the mixing chamber includes a lumen of an outlet tube that has the outlet port and that comprises a central longitudinal axis, and wherein each and every inlet conduit is disposed at the same angle, $\alpha$, where $\alpha \neq 0$, with respect to the central longitudinal axis extended.

3. An electrospray ion source as recited in claim 1, wherein each electrospray emitter comprises an emission tip and wherein all N emission tips lie on a common circle.

4. An electrospray ion source as recited in claim 3, wherein each emission tip is disposed at a distance of at least 3 mm from every other emission tip.

5. An electrospray ion source as recited in claim 4, wherein each emission tip is disposed at a distance of at least 5 mm from every other emission tip.

6. An electrospray ion source as recited in claim 2, wherein each emission tip comprises a conical portion having a cone axis, wherein each cone axis is aligned with a longitudinal axis of the inlet that is configured to receive the charged particles emitted from said each emission tip.

7. An electrospray ion source as recited in claim 1, further comprising:

a plurality of electrodes disposed within the mixing chamber between the plurality of inlets and the ion transfer tube; and a power supply configured to supply a respective DC voltage to each one of the plurality of electrodes, whereby the supplied voltages either progressively increase or progressively decrease from a first end to an opposite end of the mixing chamber, wherein the power supply is not configured to supply an RF voltage to any of the plurality of electrodes.

8. An electrospray ion source as recited in claim 1, further comprising:

a resistive member comprising an electrically resistive material disposed between the plurality of inlets and the ion transfer tube and having a first end and a second end; and a power supply configured to supply a DC voltage between the first and second ends of the resistive member.

9. An electrospray ion source as recited in claim 8, wherein the resistive member comprises at least a portion of a boundary of the mixing chamber.

10. An electrospray ion source as recited in claim 1, wherein the mixing chamber, the plurality of N inlets and the outlet port are all portions of a single integral ion transfer tube.

11. An electrospray ion source as recited in claim 2, wherein the mixing chamber, the plurality of N inlets and the outlet tube are all sections of a single integral ion transfer tube.

12. An electrospray ion source as recited in claim 1, wherein a portion of a surface of the mixing chamber is shaped as a portion of a funnel.

13. A mass spectrometry method comprising:

(a) providing an ionization compartment;

(b) providing a mixing chamber;

(c) providing an outlet port configured to transfer charged particles from the mixing chamber to an evacuated compartment of a mass spectrometer; and (d) providing a plurality of N electrospray emitters within the ionization compartment, wherein each electrospray emitter comprises an emission tip comprising a conduit that is disposed at an angle, $\alpha$, where $\alpha \neq 0$, to an extension of a longitudinal axis of the mixing chamber and wherein no two emission tips are within 3 mm of one other; and (e) providing a plurality of inlets, each inlet comprising a conduit configured to receive a portion of the charged particles from a respective one of the electrospray emitters and to transfer the portion of the charged particles into the mixing chamber.

14. A mass spectrometry method as recited in claim 13, wherein the angle, $\alpha$, is ten degrees.

15. A mass spectrometry method as recited in claim 13, further comprising:

(f) providing a plurality of electrodes disposed within the mixing chamber between the plurality of inlets and the outlet port; and (g) providing a power supply configured to supply a respective DC voltage to each one of the plurality of electrodes, wherein the DC voltages are configured to urge charged particles towards the ion transfer tube.

16. A mass spectrometry method as recited in claim 13, wherein the providing of the plurality of N electrospray emitters comprises configuring the plurality of electrospray emitters such that no two emission tips are within 5 mm of one other.

17. A mass spectrometry method as recited in claim 13, further comprising:

providing a liquid distributor configured to divide a flow of liquid sample into N equal flow portions; and providing N liquid transfer lines, each of which is configured to transfer a respective one of the flow portions to a respective one of the emitters.

18. A mass spectrometry method as recited in claim 13, further comprising:

determining the angle, $\alpha$, by gas dynamics calculations.

19. A mass spectrometry system comprising:

a sample supply line configured to supply a continuous flow of liquid sample at a supply-line volumetric flow rate;

a flow distributor configured to receive the flow of the liquid sample at an input port thereof and further configured to divide the flow into N equal portions, each portion delivered to a respective one of N output ports of the flow distributor at a flow rate of substantially 1/N of the supply-line volumetric flow rate;

a plurality of N distribution lines, each line configured to receive a respective one of the N equal flow portions from a respective one of the output ports;

a plurality of N electrospray emitters, each electrospray emitter configured to receive a respective one of the N equal flow portions from a respective one of the distribution lines and to emit, from a respective emission tip thereof, a spray jet comprising charged particles generated from the respective flow portion and gas, wherein each emission tip is disposed at a distance of at least 3 mm from every other emission tip;

a mixing chamber;

a plurality of N inlets, each inlet configured to receive the spray jet emitted from a respective one of the electrospray emitters and to transfer the received spray jet into the mixing chamber;

an outlet tube configured to transfer a mixture of the charged particles of the plurality of spray jets to an evacuated chamber of a mass spectrometer, the evacuated chamber maintained at a pressure of 1 5 Torr; and a heater thermally coupled to the outlet tube.

20. A mass spectrometry system as recited in claim 19, wherein the ion transfer tube comprises a central longitudinal axis and wherein each and every inlet conduit is disposed at a same angle, $\alpha$, where $\alpha \neq 0$, with respect to the central longitudinal axis extended.

21. A mass spectrometry system as recited in claim 19, wherein all N emission tips lie on a common circle.

22. A mass spectrometry system as recited in claim 20, wherein each emission tip comprises a conical portion having a cone axis, wherein each cone axis is aligned with a longitudinal axis of the inlet that is configured to receive the charged particles emitted from said each emission tip.

23. A mass spectrometry system as recited in claim 19, wherein each emission tip is disposed at a distance of at least 5 mm from every other emission tip.

24. An electrospray ion source for a mass spectrometer comprising:

a plurality of N electrospray emitters within an ionization compartment, wherein $N \geq 2$;

a mixing chamber;

a plurality of N inlets, each inlet comprising a conduit configured to receive charged particles from a respective one of the electrospray emitters and to emit the charged particles into the mixing chamber;

an outlet port either facing or within an intermediate-vacuum compartment; and a heater in thermal contact with at least a portion of the mixing chamber, wherein the mixing chamber includes a lumen of an outlet tube that has the outlet port and that comprises a central longitudinal axis, and wherein a first portion of the inlet conduits are disposed at an angle, $\alpha 1$, with respect to the central longitudinal axis extended and a second portion of the inlet conduits are disposed at an angle, $\alpha 2$, with respect to the central longitudinal axis extended, where $\alpha 1 \neq \alpha 2$.

* * * * *